US007135264B2

(12) United States Patent
Qian et al.

(10) Patent No.: US 7,135,264 B2
(45) **Date of Patent: *Nov. 14, 2006**

(54) ORGANOSOL INCLUDING AMPHIPATHIC COPOLYMERIC BINDER AND USE OF THE ORGANOSOL TO MAKE DRY TONERS FOR ELECTROGRAPHIC APPLICATIONS

(75) Inventors: Julie Y. Qian, Woodbury, MN (US); Gay L. Herman, Cottage Grove, MN (US); James A. Baker, Hudson, WI (US)

(73) Assignee: Samsung Electronics Company, Suwon (KR)

( * ) Notice: Subject to any disclaimer, the term of this patent is extended or adjusted under 35 U.S.C. 154(b) by 157 days.

This patent is subject to a terminal disclaimer.

(21) Appl. No.: 10/612,243

(22) Filed: Jun. 30, 2003

(65) Prior Publication Data

US 2004/0091806 A1 May 13, 2004

Related U.S. Application Data

(60) Provisional application No. 60/425,468, filed on Nov. 12, 2002.

(51) Int. Cl.
*G03G 9/087* (2006.01)

(52) U.S. Cl. ..... 430/109.31; 430/109.1; 430/109.3; 430/120; 430/137.1

(58) Field of Classification Search ..... 430/110.2, 430/111.4, 137.12, 137.17, 109.31, 109.1, 430/109.3, 120, 137.1
See application file for complete search history.

(56) References Cited

U.S. PATENT DOCUMENTS

| | | | | |
|---|---|---|---|---|
| 3,411,936 | A | 11/1968 | Roteman et al. | 117/37 |
| 4,268,598 | A | 5/1981 | Leseman et al. | 430/107 |
| 4,321,404 | A | 3/1982 | Williams et al. | 560/115 |
| 4,476,210 | A | 10/1984 | Croucher et al. | 430/114 |
| 4,613,559 | A | 9/1986 | Ober et al. | 430/137 |
| 4,727,011 | A | 2/1988 | Mahabadi et al. | 430/138 |
| 4,728,983 | A | 3/1988 | Zwadlo et al. | 355/4 |
| 4,762,764 | A | 8/1988 | Ng et al. | 430/115 |
| 4,794,651 | A | 12/1988 | Landa et al. | 430/110 |
| 4,937,167 | A | 6/1990 | Moffat et al. | 430/137 |
| 4,965,161 | A | 10/1990 | Mahmud | 430/109 |
| 4,978,598 | A | 12/1990 | Elmasry et al. | 430/137 |
| 5,023,159 | A | 6/1991 | Ong et al. | 430/109 |
| 5,061,587 | A | 10/1991 | Tsubuko et al. | 430/109 |
| 5,115,277 | A | 5/1992 | Camis | 355/273 |
| 5,262,259 | A | 11/1993 | Chou et al. | 430/47 |
| 5,264,315 | A | 11/1993 | Tan et al. | 430/137 |
| 5,384,226 | A | 1/1995 | Kanakura et al. | 430/137 |
| 5,410,392 | A | 4/1995 | Landa | 355/271 |
| 5,529,873 | A | 6/1996 | Chiba et al. | 430/109 |
| 5,650,253 | A | 7/1997 | Baker et al. | 430/119 |
| 5,652,282 | A | 7/1997 | Baker et al. | 523/201 |
| 5,698,616 | A | 12/1997 | Baker et al. | 523/201 |
| 5,886,067 | A | 3/1999 | Li et al. | 523/201 |
| 5,916,718 | A | 6/1999 | Kellie et al. | 430/45 |
| 5,965,314 | A | 10/1999 | Herman et al. | 430/126 |
| 6,037,090 | A | 3/2000 | Tanaka et al. | 430/106 |
| 6,088,560 | A | 7/2000 | Zenk et al. | 399/237 |
| 6,102,526 | A | 8/2000 | Tunius | 347/55 |
| 6,103,781 | A | 8/2000 | Li et al. | 523/201 |
| 6,136,490 | A * | 10/2000 | Ogawa et al. | 430/137.12 |
| 6,210,852 | B1 | 4/2001 | Nakamura | 430/110 |
| 6,221,545 | B1 | 4/2001 | Tran et al. | 430/10 |
| 6,248,494 | B1 | 6/2001 | Yamazaki et al. | 430/110 |
| 6,255,363 | B1 | 7/2001 | Baker et al. | 523/201 |
| 6,316,157 | B1 | 11/2001 | Yoshikawa et al. | 430/110 |
| 6,352,810 | B1 | 3/2002 | Jiang et al. | 430/137.11 |
| 6,475,685 | B1 | 11/2002 | Uchida et al. | 430/99 |
| 6,546,221 | B1 | 4/2003 | Baker et al. | 399/237 |
| 6,647,234 | B1 | 11/2003 | Herman et al. | 399/238 |
| 6,649,316 | B1 | 11/2003 | Baker et al. | 430/114 |

FOREIGN PATENT DOCUMENTS

| | | | |
|---|---|---|---|
| EP | 1229057 | A2 | 8/2002 |
| EP | 1251406 | A2 | 10/2002 |
| JP | 05-119529 | | 5/1993 |
| JP | 2004-035736 | | 2/2004 |
| WO | WO 92/17825 | | 10/1992 |
| WO | WO97/12284 | | 4/1997 |
| WO | WO98/24002 | | 6/1998 |
| WO | WO01/79318 | A1 | 10/2001 |
| WO | WO01/79363 | A2 | 10/2001 |
| WO | WO01/79364 | A2 | 10/2001 |

OTHER PUBLICATIONS

Copy of European Search Report for EP1420304 A1 issued on Mar. 18, 2004.

(Continued)

*Primary Examiner*—John L Goodrow
(74) *Attorney, Agent, or Firm*—Kagan Binder, PLLC

(57) ABSTRACT

The present invention relates to amphipathic copolymeric binder particles chemically grown in a substantially non-aqueous liquid carrier to form an organosol. The invention also pertains to dry particulate electrographic toners incorporating an organosol comprising an amphipathic copolymer wherein the amphipathic copolymer incorporates one or more S portions and one or more D portions. Methods of making dry electrophotographic toner particles, and methods of electrographically forming an image on a substrate using these toners, are also described. Preferably, fluidized drying techniques are used to form the dry toner particles from the organosol.

52 Claims, No Drawings

OTHER PUBLICATIONS

U.S. Appl. No. 10/612,535, filed Jun. 30, 2003, entitled "Organosol Including Amphipathic Copolymeric Binder Having Crystalline Material, and use of the Organosol to Make Dry Toners for Electrographic Applications" (32 pgs.).
U.S. Appl. No. 10/612,534, filed Jun. 30, 2003, entitled "Organosol Liquid Toner Including Amphipathic Copolymeric Binder Having Crystalline Component" (35 pgs.).
U.S. Appl. No. 10/612,765, filed Jun. 30, 2003, entitled "Organosol Including High Tg Amphipathic Copolymeric Binder and Liquid Toners for Electrophotographic Applications" (26 pgs.).
U.S. Appl. No. 10/612,533, filed Jun. 30, 2003, entitled "Organosol Including Amphipathic Copolymeric Binder Made With Soluble High Tg Monomer and Liquid Toners for Electrophotographic Applications" (29 pgs.).

* cited by examiner

ORGANOSOL INCLUDING AMPHIPATHIC COPOLYMERIC BINDER AND USE OF THE ORGANOSOL TO MAKE DRY TONERS FOR ELECTROGRAPHIC APPLICATIONS

This application claims the benefit of U.S. Provisional Application Ser. No. 60/425,468, filed Nov. 12, 2002, entitled "ORGANOSOL INCLUDING AMPHIPATHIC POLYMERIC BINDER AND USE OF THE ORGANOSOL TO MAKE DRY TONERS FOR ELECTROGRAPHIC APPLICATIONS," which application is incorporated herein by reference in its entirety.

FIELD OF THE INVENTION

The present invention relates to dry toner particles having utility in electrography, particularly electrophotography. More specifically, the present invention relates to amphipathic copolymeric binder particles that are chemically grown as a component of an organosol and then incorporated into dry toner particles.

BACKGROUND OF THE INVENTION

In electrophotographic and electrostatic printing processes (collectively electrographic processes), an electrostatic image is formed on the surface of a photoreceptive element or dielectric element, respectively. The photoreceptive element or dielectric element may be an intermediate transfer drum or belt or the substrate for the final toned image itself, as described by Schmidt, S. P. and Larson, J. R. in Handbook of Imaging Materials Diamond, A. S., Ed: Marcel Dekker: New York; Chapter 6, pp 227–252, and U.S. Pat. Nos. 4,728,983, 4,321,404, and 4,268,598.

In electrostatic printing, a latent image is typically formed by (1) placing a charge image onto a dielectric element (typically the receiving substrate) in selected areas of the element with an electrostatic writing stylus or its equivalent to form a charge image, (2) applying toner to the charge image, and (3) fixing the toned image. An example of this type of process is described in U.S. Pat. No. 5,262,259.

In electrophotographic printing, also referred to as xerography, electrophotographic technology is used to produce images on a final image receptor, such as paper, film, or the like. Electrophotographic technology is incorporated into a wide range of equipment including photocopiers, laser printers, facsimile machines, and the like.

Electrophotography typically involves the use of a reusable, light sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, and cleaning, and erasure.

In the charging step, a photoreceptor is covered with charge of a desired polarity, either negative or positive, typically with a corona or charging roller. In the exposure step, an optical system, typically a laser scanner or diode array, forms a latent image by selectively discharging the charged surface of the photoreceptor in an imagewise manner corresponding to the desired image to be formed on the final image receptor. In the development step, toner particles of the appropriate polarity are generally brought into contact with the latent image on the photoreceptor, typically using a developer electrically-biased to a potential opposite in polarity to the toner polarity. The toner particles migrate to the photoreceptor and selectively adhere to the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor. In the fusing step, the toned image on the final image receptor is heated to soften or melt the toner particles, thereby fusing the toned image to the final receptor. An alternative fusing method involves fixing the toner to the final receptor under high pressure with or without heat. In the cleaning step, residual toner remaining on the photoreceptor is removed.

Finally, in the erasing step, the photoreceptor charge is reduced to a substantially uniformly low value by exposure to light of a particular wavelength band, thereby removing remnants of the original latent image and preparing the photoreceptor for the next imaging cycle.

Two types of toner are in widespread, commercial use: liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles in that liquid toner particles are solvatable to some degree, typically in more than 50 weight percent of a low polarity, low dielectric carrier solvent; and liquid toner particles are generally chemically charged using polar groups that dissociate in the carrier solvent, but do not carry a triboelectric charge while solvated and/or dispersed in the liquid carrier.

A typical dry toner particle generally comprises a polymeric binder and optionally a visual enhancement additive, e.g., a colored pigment particle. The binder fulfills functions both during and after the electrophotographic process. With respect to processability, the character of the binder impacts the triboelectric charging and charge retention characteristics, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact durability (e.g. blocking and erasure resistance), adhesion to the receptor, gloss, and the like.

For example, polymeric materials suitable for use in dry toner particles typically have a high glass transition temperature ($T_g$) of at least about 50–65° C. in order to obtain good blocking resistance after fusing, yet typically require high fusing temperatures of about 200–250° C. in order to soften or melt the toner particles and thereby adequately fuse the toner to the final image receptor. High fusing temperatures are a disadvantage for dry toner because of the long warm-up time and higher energy consumption associated with high temperature fusing and because of the risk of fire associated with fusing toner to paper at temperatures approaching the autoignition temperature of paper (233° C.).

In addition, some dry toners using high $T_g$ polymeric binders are known to exhibit undesirable partial transfer (offset) of the toned image from the final image receptor to the fuser surface at temperatures above or below the optimal fusing temperature, requiring the use of low surface energy materials in the fuser surface or the application of fuser oils to prevent offset. Alternatively, various lubricants or waxes have been physically blended into the dry toner particles during fabrication to act as release or slip agents; however, because these waxes are not chemically bonded to the polymeric binder, they may adversely affect triboelectric charging of the toner particle or may migrate from the toner particle and contaminate the photoreceptor, an intermediate transfer element, the fuser element, or other surfaces critical to the electrophotographic process. In addition to the visual enhancement additive and the polymeric binder, dry toner particles may optionally include other additives.

Charge control additives (charge directors, charge control agents or CCA's) are often used in dry toner when the other ingredients, by themselves, do not provide the desired triboelectric charging or charge retention properties. As noted above, release or slip agents may be used to help prevent the toner from sticking to fuser rolls when those are used, thereby preventing or reducing offset. Other additives include antioxidants, ultraviolet stabilizers, fungicides, bactericides, flow control agents, and the like.

Dry toner particles have been manufactured using a wide range of fabrication techniques. One widespread fabrication technique involves melt mixing the ingredients, comminuting the solid blend that results to form particles, and then classifying the resultant particles to remove fines and larger material of unwanted particle size. External additives may then be blended with the resultant particles. This approach has drawbacks. First, the approach necessitates the use of polymeric binder materials that are friable or fracturable to some degree so that comminution can be carried out. This limits the kinds of polymeric materials that can be used, including materials that are fracture resistant and highly durable. This also limits the kinds of colorants to be used, in that some materials such as metal flakes, or the like, may tend to be damaged to too large a degree by the energy encountered during comminution.

The amount of energy required by comminution itself is a drawback in terms of equipment demands and associated manufacturing expenses. Also, material usage is inefficient in that fines and larger particles are unwanted and must be screened out from the desired product. In short, significant material is wasted. Recycling of unused material is not always practical to reduce such waste inasmuch as the composition of recycled material may tend to shift from what is desired.

Relatively recently, chemically grown dry toner materials have been made using a variety of methods. In such methods, the polymeric binder is typically manufactured as a dispersion in aqueous media by solution, suspension, or emulsion polymerization techniques under conditions that form monodisperse, polymeric particles that are fairly uniform in size and shape. After the polymeric binder is formed, it is filtered and washed to remove unreacted monomer, surfactants and other extraneous material, then dried and combined with other desired ingredients to form a dry toner powder. Because the high boiling point and large latent heat of vaporization of water makes it impractical and expensive to evaporate all of the aqueous media to obtain a dry polymeric binder, drying of the binder is often effected by filtration to remove a substantial amount of the water, followed by evaporative drying to remove substantially all of the remaining aqueous media.

Solvent-based polymer dispersions in a nonaqueous liquid (organosols) have been prepared using dispersion polymerization in low polarity, low dielectric constant carrier solvents for use in making relatively low glass transition temperature ($T_g \leqq 30°$ C.) film-forming liquid electrophotographic toners. See, e.g., U.S. Pat. No. 5,886,067 and 6,103,781. Organosols have also been prepared for use in making intermediate glass transition temperature ($T_g$ 30–55° C.) liquid electrostatic toners for use in electrostatic stylus printers. See e.g. U.S. Pat. No. 6,255,363 B1.

Some solvent-based polymer dispersions have also been developed for producing dry toners. See, e.g., U.S. Pat. Nos. 6,136,490 and 5,384,226 and Japanese Published Patent Document No. 05-119529. Unfortunately, the use of organosols or solvent-based polymer dispersion to make dry toner particles has proved to be substantially more challenging than the use of organosols to make liquid toner compositions. When a solvent-based dispersion is dried to remove the nonaqueous liquid carrier as is necessary to make dry toner particles, the binder particles tend to agglomerate and/or aggregate into one or more large masses. Such masses must be pulverized or otherwise comminuted in order to obtain dry toner particles of an appropriate size. The need for such comminution defeats a major advantage of using organosols in the first instance, which is the formation of substantially monodisperse, polymeric particles of uniform size and shape. In addition, it has been reported to be more difficult to incorporate slip agents (e.g. waxes) or triboelectric charge control additives (CCA's) into nonaqueous dispersions due to solubility constraints and other considerations. Consequently, the full spectrum of benefits that result from using organosols has not been realized for widespread, commercial, dry toner applications.

Particle size and charge characteristics are especially important to form high quality images with good resolution using dry toners. Dry toner particles must be as uniform in size, charge rate, and charge holding characteristics as is practically possible in order to maximize image forming performance. Accordingly, there is always a demand in this industry for techniques that yield dry toner particles with more uniform particle size, charging rate, and/or charge holding characteristics. There is also a demand for new polymeric binders for dry toners that exhibit controllable particle size, shape and charge polarity; improved charging characteristics and charge stability; improved low temperature fusing performance; and lower manufacturing cost arising from improved yields, reduced processing steps, or more efficient processing methods.

SUMMARY OF THE INVENTION

The present invention relates to dry toner particles derived from an organosol comprising chemically grown, copolymeric binder particles dispersed in a substantially nonaqueous liquid carrier, e.g. an organic solvent. The resultant organosol is easily combined with other desired ingredients and dried to the desired degree to form free-flowing dry toner particles with a relatively narrow particle size distribution. In preferred embodiments, drying is preferably accomplished while the particles are in a fluidized condition (explained further below). As a distinct advantage, organosol compositions, in contrast to some other kinds of polymer-containing compositions, are very easily fluidized to carry out drying in preferred modes of practice. The resultant particles of such preferred embodiments have uniform particle size, shape, charge rate, and charge holding characteristics.

Additionally, because the copolymeric binder particles have uniform size characteristics, there is no need, if desired, for comminution and the associated particle size screening and classification. Consequently, materials are used efficiently and the intense energy cost of comminution is avoided, if desired.

Formulation flexibility is also expanded inasmuch as there is no limitation to use materials that are compatible with comminution. Additionally, a wide range of liquid carrier soluble or dispersible monomers may be used to form the organosol by a variety of substantially nonaqueous polymerization methods. Preferably, substantially nonaqueous dispersion polymerization is used to polymerize monomers using free radical polymerization methods as desired. As used herein, "substantially nonaqueous polymerization methods" refers to polymerization methods in an organic solvent containing at most aminor portion of water.

As another advantage, the organosol and other ingredients used to make dry toner particles tend to be readily mixed together at relatively low shear as compared to other kinds of ingredients, due to the inherently low viscosities of organosols. The energy demands of mixing are thus reduced. Some shear-sensitive ingredients also tend to experience less damage than might be the case if higher energy mixing techniques were to be used.

The dry toner particles advantageously are obtained from ingredients that include an organosol comprising an amphipathic copolymer and optionally at least one visual enhancement additive, e.g., a colorant particle. As used herein, the term "amphipathic" is well known and refers to a copolymer having a combination of portions having distinct solubility and dispersibility characteristics, respectively, in a desired liquid carrier that is used to make the copolymer and/or used in the course of incorporating the copolymer into the dry toner particles. Preferably, the liquid carrier is selected such that at least one portion (also referred to herein as S material or portion(s)) of the copolymer is more solvated by the carrier while at least one other portion (also referred to herein as D material or portion(s)) of the copolymer constitutes more of a dispersed phase in the carrier.

In preferred embodiments, the copolymer is polymerized in situ in the desired substantially nonaqueous liquid carrier as this yields monodisperse copolymeric particles suitable for use in toner with little, if any, need for subsequent comminuting or classifying. The resulting organosol is then converted into toner particles optionally by mixing the organosol with at least one visual enhancement additive and optionally one or more other desired ingredients. During such combination, ingredients comprising the visual enhancement particles and the amphipathic copolymer will tend to self-assemble into composite toner particles. Specifically, it is believed that the D portion of the copolymer will tend to physically and/or chemically interact with the surface of the visual enhancement additive, while the S portion helps promote dispersion in the carrier without use of a separate surfactant or dispersant. The dispersion is then dried to the desired degree to provide composite dry toner particles, preferably using the fluidized drying techniques described herein.

In one aspect, the present invention relates to a dry electrographic toner incorporating a copolymeric binder derived from an organosol, wherein the organosol comprises an amphipathic copolymer dispersed in a substantially nonaqueous carrier liquid. In certain preferred embodiments, the dry electrophotographic toner further comprises at least one visual enhancement additive and/or a charge control additive.

In one preferred embodiment, the present invention relates to a dry electrophotographic toner incorporating a high glass transition temperature copolymeric binder derived from an organosol, wherein the organosol comprises an amphipathic copolymer dispersed in a substantially nonaqueous carrier liquid. In certain preferred embodiments, the dry electrophotographic toner further comprises at least one visual enhancement additive and/or a charge control additive.

In another aspect, the present invention relates to a method of making dry electrophotographic toner particles. An organosol comprising a plurality of binder particles dispersed in a liquid carrier is provided. The binder particles comprise at least one amphipathic copolymer. The binder particles are incorporated into a plurality of dry electrophotographic toner particles.

In another aspect, the present invention relates to a method of making dry electrophotographic toner particles. An organosol comprising a plurality of binder particles dispersed in a liquid carrier is provided. The binder particles comprise at least one amphipathic copolymer. The binder particles are incorporated into dry electrophotographic toner particles. This incorporation includes the steps of:

(i) causing the organosol to mixingly contact one or more ingredients comprising at least one colorant under conditions effective to form a dispersion; and (ii) drying the dispersion, said dispersion being in a fluidized state during at least a portion of said drying step.

In another aspect, the present invention relates to a method of making electrophotographic toner particles. A plurality of free radically polymerizable, monomers is provided, wherein at least one of the monomers comprises hydroxyl functionality. The monomers are free radically polymerized in a solvent to form a hydroxyl functional polymer, wherein the monomers and the hydroxyl functional polymer are soluble in the solvent. A compound having NCO functionality and free radically polymerizable functionality is reacted with the hydroxyl functional polymer under conditions such that at least a portion of the NCO functionality of the compound reacts with at least a portion of the hydroxyl functionality of the polymer to form one or more urethane linkages by which the compound is linked to the polymer, thereby providing a polymer with pendant free radically polymerizable functionality. This reaction step may or may not occur in the same solvent.

Next, ingredients comprising (i) the polymer with pendant free radically polymerizable functionality, (ii) one or more additional free radically polymerizable, monomers, and (iii) a liquid carrier in which polymeric material derived from ingredients comprising the one or more additional monomers is insoluble are reacted under conditions effective to form an organosol comprising an amphipathic copolymer dispersed in the liquid carrier. The amphipathic copolymer is incorporated into dry electrophotographic toner particles.

In another aspect, the present invention relates to a method of electrographically forming an image on a substrate surface. A plurality of dry toner particles is provided. The toner particles preferably include at least one visual enhancement additive and a polymeric binder derived from ingredients comprising an amphipathic copolymer. An image comprising the toner particles is formed on the substrate surface.

In another aspect, the present invention relates to a method of electro-photographically forming an image on a substrate surface. A plurality of dry toner particles is provided. The toner particles preferably include at least one visual enhancement additive and a polymeric binder derived from an organosol comprising an amphipathic copolymer. An image comprising the toner particles is formed on a charged surface. The image from the charged surface is transferred to the substrate surface.

DETAILED DESCRIPTION OF PRESENTLY PREFERRED EMBODIMENTS

The embodiments of the present invention described below are not intended to be exhaustive or to limit the invention to the precise forms disclosed in the following detailed description. Rather the embodiments are chosen and described so that others skilled in the art may appreciate and understand the principles and practices of the present invention.

Preferably, the nonaqueous liquid carrier of the organosol is selected such that at least one portion (also referred to herein as the S material or portion) of the amphipathic copolymer is more solvated by the carrier while at least one other portion (also referred to herein as the D material or portion) of the copolymer constitutes more of a dispersed phase in the carrier. Preferred copolymers of the present invention comprise S and D material having respective solubilities in the desired liquid carrier that are sufficiently different from each other such that the S blocks tend to be more solvated by the carrier while the D blocks tend to be more dispersed in the carrier. More preferably, the S blocks are soluble in the liquid carrier while the D blocks are insoluble. In particularly preferred embodiments, the D material phase separates from the liquid carrier, forming dispersed particles.

From one perspective, the polymer particles when dispersed in the liquid carrier may be viewed as having a core/shell structure in which the D material tends to be in the core, while the S material tends to be in the shell. The S material thus functions as a dispersing aid, steric stabilizer or graft copolymer stabilizer, to help stabilize dispersions of the copolymer particles in the liquid carrier. Consequently, the S material may also be referred to herein as a "graft stabilizer." The core/shell structure of the binder particles tends to be retained when the particles are dried and when incorporated into dry toner particles.

The solubility of a material, or a portion of a material such as a copolymeric portion, may be qualitatively and quantitatively characterized in terms of its Hildebrand solubility parameter. The Hildebrand solubility parameter refers to a solubility parameter represented by the square root of the cohesive energy density of a material, having units of $(\text{pressure})^{1/2}$, and being equal to $(\Delta H/RT)^{1/2}/V^{1/2}$, where $\Delta H$ is the molar vaporization enthalpy of the material, R is the universal gas constant, T is the absolute temperature, and V is the molar volume of the solvent. Hildebrand solubility parameters are tabulated for solvents in Barton, A. F. M., *Handbook of Solubility and Other Cohesion Parameters,* 2d Ed. CRC Press, Boca Raton, Fla., (1991), for monomers and representative polymers in *Polymer Handbook,* 3rd Ed., J. Brandrup & E. H. Immergut, Eds. John Wiley, N.Y., pp 519–557 (1989), and for many commercially available polymers in Barton, A. F. M., *Handbook of Polymer-Liquid Interaction Parameters and Solubility Parameters*, CRC Press, Boca Raton, Fla., (1990).

The degree of solubility of a material, or portion thereof, in a liquid carrier may be predicted from the absolute difference in Hildebrand solubility parameters between the material, or portion thereof, and the liquid carrier. A material, or portion thereof, will be fully soluble or at least in a highly solvated state when the absolute difference in Hildebrand solubility parameter between the material, or portion thereof, and the liquid carrier is less than approximately 1.5 $MPa^{1/2}$. On the other hand, when the absolute difference between the Hildebrand solubility parameters exceeds approximately 3.0 $MPa^{1/2}$, the material, or portion thereof, will tend to phase separate from the liquid carrier, forming a dispersion. When the absolute difference in Hildebrand solubility parameters is between 1.5 $MPa^{1/2}$ and 3.0 $MPa^{1/2}$, the material, or portion thereof, is considered to be weakly solvatable or marginally insoluble in the liquid carrier.

Consequently, in preferred embodiments, the absolute difference between the respective Hildebrand solubility parameters of the S portion(s) of the copolymer and the liquid carrier is less than 3.0 MPa 1, preferably less than about 2.0 $MPa^{1}$, more preferably less than about 1.5 $MPa^{1/2}$. In a particularly preferred embodiment of the present invention, the absolute difference between the respective Hildebrand solubility parameters of the S portion(s) of the copolymer and the liquid carrier is from about 2 to about 3.0 $MPa^{1/2}$. Additionally, it is also preferred that the absolute difference between the respective Hildebrand solubility parameters of the D portion(s) of the copolymer and the liquid carrier is greater than 2.3 $MPa^{1/2}$, preferably greater than about 2.5 $MPa^{1/2}$, more preferably greater than about 3.0 $MPa^{1/2}$, with the proviso that the difference between the respective Hildebrand solubility parameters of the S and D portion(s) is at least about 0.4 $MPa^{1/2}$, more preferably at least about 1.0 $MPa^{1/2}$. Because the Hildebrand solubility of a material may vary with changes in temperature, such solubility parameters are preferably determined at a desired reference temperature such as at 25° C.

Those skilled in the art understand that the Hildebrand solubility parameter for a copolymer, or portion thereof, may be calculated using a volume fraction weighting of the individual Hildebrand solubility parameters for each monomer comprising the copolymer, or portion thereof, as described for binary copolymers in Barton A. F. M., *Handbook of Solubility Parameters and Other Cohesion Parameters*, CRC Press, Boca Raton, p 12 (1990). The magnitude of the Hildebrand solubility parameter for polymeric materials is also known to be weakly dependent upon the weight average molecular weight of the polymer, as noted in Barton, pp 446–448. Thus, there will be a preferred molecular weight range for a given polymer or portion thereof in order to achieve desired solvating or dispersing characteristics. Similarly, the Hildebrand solubility parameter for a mixture may be calculated using a volume fraction weighting of the individual Hildebrand solubility parameters for each component of the mixture.

In addition, we have defined our invention in terms of the calculated solubility parameters of the monomers and solvents obtained using the group contribution method developed by Small, P. A., J. Appl. Chem., 3, 71 (1953) using Small's group contribution values listed in Table 2.2 on page VII/525 in the Polymer Handbook, 3rd Ed., J. Brandrup & E. H. Immergut, Eds. John Wiley, New York, (1989). We have chosen this method for defining our invention to avoid ambiguities which could result from using solubility parameter values obtained with different experimental methods. In addition, Small's group contribution values will generate solubility parameters that are consistent with data derived from measurements of the enthalpy of vaporization, and therefore are completely consistent with the defining expression for the Hildebrand solubility parameter. Since it is not practical to measure the heat of vaporization for polymers, monomers are a reasonable substitution.

For purposes of illustration, Table I lists Hildebrand solubility parameters for some common solvents used in an electrophotographic toner and the Hildebrand solubility parameters and glass transition temperatures (based on their high molecular weight homopolymers) for some common monomers used in synthesizing organosols.

TABLE I

Hildebrand Solubility Parameters

Solvent Values at 25° C.

| Solvent Name | Kauri-Butanol Number by ASTM Method D1133-54T (ml) | Hildebrand Solubility Parameter ($MPa^{1/2}$) |
|---|---|---|
| Norpar ™ 15 | 18 | 13.99 |
| Norpar ™ 13 | 22 | 14.24 |
| Norpar ™ 12 | 23 | 14.30 |
| Isopar ™ V | 25 | 14.42 |
| Isopar ™ G | 28 | 14.60 |
| Exxsol ™ D80 | 28 | 14.60 |

Source: Calculated from equation #31 of Polymer Handbook, 3rd Ed., J. Brandrup E. H. Immergut, Eds. John Wiley, NY, p. VII/522 (1989).

Monomer Values at 25° C.

| Monomer Name | Hildebrand Solubility Parameter ($MPa^{1/2}$) | Glass Transition Temperature (° C.)* |
|---|---|---|
| 3,3,5-Trimethyl Cyclohexyl Methacrylate | 16.73 | 125 |
| Isobornyl Methacrylate | 16.90 | 110 |
| Isobornyl Acrylate | 16.01 | 94 |
| n-Behenyl acrylate | 16.74 | <−55 (58 m.p.)** |
| n-Octadecyl Methacrylate | 16.77 | −100 (45 m.p.)** |
| n-Octadecyl Acrylate | 16.82 | −55 |
| Lauryl Methacrylate | 16.84 | −65 |
| Lauryl Acrylate | 16.95 | −30 |
| 2-Ethylhexyl Methacrylate | 16.97 | −10 |
| 2-Ethylhexyl Acrylate | 17.03 | −55 |
| n-Hexyl Methacrylate | 17.13 | −5 |
| t-Butyl Methacrylate | 17.16 | 107 |
| n-Butyl Methacrylate | 17.22 | 20 |
| n-Hexyl Acrylate | 17.30 | −60 |
| n-Butyl Acrylate | 17.45 | −55 |
| Ethyl Methacrylate | 17.62 | 65 |
| Ethyl Acrylate | 18.04 | −24 |
| Methyl Methacrylate | 18.17 | 105 |
| Styrene | 18.05 | 100 |

Calculated using Small's Group Contribution Method, Small, P. A. Journal of Applied Chemistry 3 p. 71 (1953). Using Group Contributions from Polymer Handbook, 3rd Ed., J. Brandrup E. H. Immergut, Eds., John Wiley, NY, p. VII/525 (1989).

*Polymer Handbook, 3rd Ed., J. Brandrup E. H. Immergut, Eds., John Wiley, NY, pp. VII/209–277 (1989). The $T_g$ listed is for the homopolymer of the respective monomer.

**m.p. refers to melting point for selected Polymerizable Crystallizable Compounds.

The liquid carrier is a substantially nonaqueous solvent or solvent blend. In other words, only a minor component (generally less than 25 weight percent) of the liquid carrier comprises water. Preferably, the substantially nonaqueous liquid carrier comprises less than 20 weight percent water, more preferably less than 10 weight percent water, even more preferably less than 3 weight percent water, most preferably less than one weight percent water.

The substantially nonaqueous carrier liquid may be selected from a wide variety of materials, or combination of materials, which are known in the art, but preferably has a Kauri-butanol number less than 30 ml. The liquid is preferably oleophilic, chemically stable under a variety of conditions, and electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the liquid carrier desirably is chemically inert in most embodiments with respect to the ingredients used to formulate the toner particles.

Examples of suitable liquid carriers include aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like) silicone oils and blends of these solvents. Preferred carrier liquids include branched paraffinic solvent blends such as Isopar™ G, Isopar™ H, Isopar™ K, Isopar™ L, Isopar™ M and Isopar™ V (available from Exxon Corporation, NJ), and most preferred carriers are the aliphatic hydrocarbon solvent blends such as Norpar™ 12, Norpar™ 13 and Norpar™ 15 (available from Exxon Corporation, NJ). Particularly preferred carrier liquids have a Hildebrand solubility parameter of from about 13 to about 15 $MPa^{1/2}$.

As used herein, the term "copolymer" encompasses both oligomeric and polymeric materials, and encompasses polymers incorporating two or more monomers. As used herein, the term "monomer" means a relatively low molecular weight material (i.e., generally having a molecular weight less than about 500 Daltons) having one or more polymerizable groups. "Oligomer" means a relatively intermediate sized molecule incorporating two or more monomers and generally having a molecular weight of from about 500 up to about 10,000 Daltons. "Polymer" means a relatively large material comprising a substructure formed two or more monomeric, oligomeric, and/or polymeric constituents and generally having a molecular weight greater than about 10,000 Daltons.

The term "macromer" or "macromonomer" refers to an oligomer or polymer having a terminal polymerizable moiety. "Polymerizable crystallizable compound" or "PCC" refers to compounds capable of undergoing polymerization to produce a polymer portion capable of undergoing reversible crystallization over a reproducible and well-defined temperature range (e.g. the copolymer exhibits a melting and freezing point as determined, for example, by differential scanning calorimetry). PCC's may include monomers, functional oligomers, functional pre-polymers, macromers or other compounds able to undergo polymerization to form a polymer portion copolymer. The term "molecular weight" as used throughout this specification means weight average molecular weight unless expressly noted otherwise.

The weight average molecular weight of the amphipathic copolymer of the present invention may vary over a wide range, and may impact imaging performance. The polydispersity of the copolymer also may impact imaging and transfer performance of the resultant dry toner material. Because of the difficulty of measuring molecular weight for an amphipathic copolymer, the particle size of the dispersed copolymer (organosol) may instead be correlated to imaging and transfer performance of the resultant dry toner material. Generally, the volume mean particle diameter ($D_v$) of the dispersed graft copolymer particles, determined by laser diffraction particle size measurement, should be in the range 0.1–100 microns, more preferably 0.5–50 microns, even more preferably 1.0–20 microns, and most preferably 3–10 microns.

In addition, a correlation exists between the molecular weight of the solvatable or soluble S portion of the graft copolymer, and the imaging and transfer performance of the resultant toner. Generally, the S portion of the copolymer has a weight average molecular weight in the range of 1000 to about 1,000,000 Daltons, preferably 5000 to 400,000 Daltons, more preferably 50,000 to 300,000 Daltons. It is also generally desirable to maintain the polydispersity (the ratio of the weight-average molecular weight to the number average molecular weight) of the S portion of the copolymer below 15, more preferably below 5, most preferably below 2.5. It is a distinct advantage of the present invention that copolymer particles with such lower polydispersity characteristics for the S portion are easily made in accordance with the practices described herein, particularly those embodiments in which the copolymer is formed in the liquid carrier in situ.

The relative amounts of S and D portions in a copolymer can impact the solvating and dispersability characteristics of these portions. For instance, if too little of the S portion(s) are present, the copolymer may have too little stabilizing effect to sterically-stabilize the organosol with respect to aggregation as might be desired. If too little of the D portion(s) are present, the small amount of D material may be too soluble in the liquid carrier such that there may be insufficient driving force to form a distinct, dispersed phase in the liquid carrier. The presence of both a solvated and dispersed phase helps the ingredients of particles self assemble in situ with exceptional uniformity among separate particles. Balancing these concerns, the preferred weight ratio of D material to S material is in the range of 1:20 to 20:1, preferably 1:1 to 15:1, more preferably 2:1 to 10:1, and most preferably 4:1 to 8:1.

Glass transition temperature, $T_g$, refers to the temperature at which a (co)polymer, or portion thereof, changes from a hard, glassy material to a rubbery, or viscous, material, corresponding to a dramatic increase in free volume as the (co)polymer is heated. The $T_g$ can be calculated for a (co)polymer, or portion thereof, using known $T_g$ values for the high molecular weight homopolymers (see, e.g., Table I herein) and the Fox equation expressed below:

$$1/T_g = w_1/T_{g1} + w_2/T_{g2} + \ldots w_i/T_{gi}$$

wherein each $w_n$ is the weight fraction of monomer "n" and each $T_{gn}$ is the absolute glass transition temperature (in degrees Kelvin) of the high molecular weight homopolymer of monomer "n" as described in Wicks, A. W., F. N. Jones & S. P. Pappas, Organic Coatings 1, John Wiley, NY, pp 54–55 (1992).

In the practice of the present invention, values of $T_g$ for the D or S portion of the copolymer were determined using the Fox equation above, although the $T_g$ of the copolymer as a whole may be determined experimentally using e.g. differential scanning calorimetry. The glass transition temperatures ($T_g$'s) of the S and D portions may vary over a wide range and may be independently selected to enhance manufacturability and/or performance of the resulting dry toner particles. The $T_g$'s of the S and D portions will depend to a large degree upon the type of monomers constituting such portions. Consequently, to provide a copolymer material with higher $T_g$, one can select one or more higher $T_g$ monomers with the appropriate solubility characteristics for the type of copolymer portion (D or S) in which the monomer(s) will be used. Conversely, to provide a copolymer material with lower $T_g$, one can select one or more lower $T_g$ monomers with the appropriate solubility characteristics for the type of portion in which the monomer(s) will be used.

For copolymers useful in dry toner applications, the copolymer $T_g$ preferably should not be too low or else receptors printed with the toner may experience undue blocking. Conversely, the minimum fusing temperature required to soften or melt the toner particles sufficient for them to adhere to the final image receptor will increase as the copolymer $T_g$ increases. Consequently, it is preferred that the $T_g$ of the copolymer be far enough above the expected maximum storage temperature of a printed receptor so as to avoid blocking issues, yet not so high as to require fusing temperatures approaching the temperatures at which the final image receptor may be damaged, e.g. approaching the autoignition temperature of paper used as the final image receptor. In this regard, incorporation of a polymerizable crystallizable compound (PCC) in the copolymer will generally permit use of a lower copolymer $T_g$ and therefore lower fusing temperatures without the risk of the image blocking at storage temperatures below the melting temperature of the PCC. Desirably, therefore, the copolymer has a $T_g$ of 0°–100° C., more preferably 20°–80° C., most preferably 40°–70° C.

The advantages of incorporating PCC's into the copolymer are further described in assignee's co-pending U.S. patent application Ser. No. 10/612,535, titled ORGANOSOL INCLUDING AMPHIPATHIC COPOLYMERIC BINDER HAVING CRYSTALLINE MATERIAL, AND USE OF THE ORGANOSOL TO MAKE DRY TONER FOR ELECTROGRAPHIC APPLICATIONS, bearing Attorney Docket No. SAM0003/US, and filed on Jun. 30, 2003, in the names of Julie Y. Qian et al., said co-pending patent application being incorporated herein by reference in its entirety.

For copolymers in which the D portion comprises a major portion of the copolymer, the $T_g$ of the D portion will dominate the $T_g$ of the copolymer as a whole. For such copolymers useful in dry toner applications, it is preferred that the $T_g$ of the D portion fall in the range of 20°–105° C., more preferably 30°–85° C., most preferably 60°75° C., since the S portion will generally exhibit a lower $T_g$ than the D portion, and a higher $T_g$ D portion is therefore desirable to offset the $T_g$ lowering effect of the S portion, which may be solvatable. In this regard, incorporation of a polymerizable crystallizable compound (PCC) in the D portion of the copolymer will generally permit use of a lower D portion $T_g$ and therefore lower fusing temperatures with reduced risk of image blocking at storage temperatures below the melting temperature of the PCC.

Blocking with respect to the S portion material is not as significant an issue inasmuch as preferred copolymers comprise a majority of the D portion material. Consequently, the $T_g$ of the D portion material will dominate the effective $T_g$ of the copolymer as a whole. However, if the $T_g$ of the S portion is too low, then the particles might tend to aggregate and/or aggregate during drying. On the other hand, if the $T_g$ is too high, then the requisite fusing temperature may be too high. Balancing these concerns, the S portion material is preferably formulated to have a $T_g$ of at least 0° C., preferably at least 20° C., more preferably at least 40° C. In this regard, incorporation of a polymerizable crystallizable compound (PCC) in the S portion of the copolymer will generally permit use of a lower S portion $T_g$ provided that the drying temperature used in forming the dry toner particles is maintained below the melting temperature of the PCC, e.g.

by using vacuum assisted drying, freeze drying, low temperature fluidized bed drying, and the like.

A wide variety of one or more different monomeric, oligomeric and/or polymeric materials may be independently incorporated into the S and D portions, as desired. Representative examples of suitable materials include free radically polymerized material (also referred to as vinyl copolymers or (meth) acrylic copolymers in some embodiments), polyurethanes, polyester, epoxy, polyamide, polyimide, polysiloxane, fluoropolymer, polysulfone, combinations of these, and the like. Preferred S and D portions are derived from free radically polymerizable material. In the practice of the present invention, "free radically polymerizable" refers to monomers, oligomers, and/or polymers having functionality directly or indirectly pendant from a monomer, oligomer, or polymer backbone (as the case may be) that participate in polymerization reactions via a free radical mechanism. Representative examples of such functionality includes (meth)acrylate groups, olefinic carbon-carbon double bonds, allyloxy groups, alpha-methyl styrene groups, (meth)acrylamide groups, cyanate ester groups, vinyl ether groups, combinations of these, and the like. The term "(meth)acryl", as used herein, encompasses acryl and/or methacryl.

Free radically polymerizable monomers, oligomers, and/or polymers are advantageously used to form the copolymer in that so many different types are commercially available and may be selected with a wide variety of desired characteristics that help provide one or more desired performance characteristics. Free radically polymerizable monomers, oligomers, and/or monomers suitable in the practice of the present invention may include one or more free radically polymerizable moieties.

Representative examples of monofunctional, free radically polymerizable monomers include styrene, alpha-methylstyrene, substituted styrene, vinyl esters, vinyl ethers, N-vinyl-2-pyrrolidone, (meth)acrylamide, vinyl naphthalene, alkylated vinyl naphthalenes, alkoxy vinyl naphthalenes, N-substituted (meth)acrylamide, octyl (meth)acrylate, nonylphenol ethoxylate (meth)acrylate, N-vinyl pyrrolidone, isononyl (meth)acrylate, isobornyl (meth)acrylate, 2-(2-ethoxyethoxy)ethyl (meth)acrylate, 2-ethylhexyl (meth)acrylate, beta-carboxyethyl (meth)acrylate, isobutyl (meth)acrylate, cycloaliphatic epoxide, alpha-epoxide, 2-hydroxyethyl (meth)acrylate, (meth)acrylonitrile, maleic anhydride, itaconic acid, isodecyl (meth)acrylate, lauryl (dodecyl) (meth)acrylate, stearyl (octadecyl) (meth)acrylate, behenyl (meth)acrylate, n-butyl (meth)acrylate, methyl (meth)acrylate, ethyl (meth)acrylate, hexyl (meth)acrylate, (meth)acrylic acid, N-vinylcaprolactam, stearyl (meth)acrylate, hydroxy functional caprolactone ester (meth)acrylate, isooctyl (meth)acrylate, hydroxyethyl (meth)acrylate, hydroxymethyl (meth)acrylate, hydroxypropyl (meth)acrylate, hydroxyisopropyl (meth)acrylate, hydroxybutyl (meth) acrylate, hydroxyisobutyl (meth)acrylate, tetrahydrofurfuryl (meth)acrylate, isobornyl (meth)acrylate, glycidyl (meth) acrylate vinyl acetate, combinations of these, and the like.

Preferred copolymers of the present invention may be formulated with one or more radiation curable monomers or combinations thereof that help the free radically polymerizable compositions and/or resultant cured compositions to satisfy one or more desirable performance criteria. For example, in order to promote hardness and abrasion resistance, a formulator may incorporate one or more free radically polymerizable monomer(s) (hereinafter "high $T_g$ component") whose presence causes the polymerized material, or a portion thereof, to have a higher glass transition temperature, $T_g$, as compared to an otherwise identical material lacking such high $T_g$ component. Preferred monomeric constituents of the high $T_g$ component generally include monomers whose homopolymers have a $T_g$ of at least about 50° C., preferably at least about 60° C., and more preferably at least about 75° C. in the cured state.

An exemplary class of radiation curable monomers that tend to have relatively high $T_g$ characteristics suitable for incorporation into the high $T_g$ component generally comprise at least one radiation curable (meth)acrylate moiety and at least one nonaromatic, alicyclic and/or nonaromatic heterocyclic moiety. Isobornyl (meth)acrylate is a specific example of one such monomer. A cured, homopolymer film formed from isobornyl acrylate, for instance, has a $T_g$ of 110° C. The monomer itself has a molecular weight of 222 g/mole, exists as a clear liquid at room temperature, has a viscosity of 9 centipoise at 25° C., and has a surface tension of 31.7 dynes/cm at 25° C. Additionally, 1,6-Hexanediol di(meth)acrylate is another example of a monomer with high $T_g$ characteristics.

Trimethyl cyclohexyl methacrylate (TCHMA) is another example of a high $T_g$ monomer useful in the practice of the present invention. TCHMA has a $T_g$ of 125° C. and tends to be soluble in oleophilic solvents. Consequently, TCHMA is easily incorporated into S material. However, if used in limited amounts so as not to unduly impair the insolubility characteristics of D material, some TCHMA may also be incorporated into D the material.

In a particularly preferred embodiment of the present invention, the S portion of the copolymer has a glass transition temperature calculated using the Fox equation (excluding grafting site components) of at least about 90° C., and more preferably has a glass transition temperature calculated using the Fox equation (excluding grafting site components) of from about 100° C. to about 130° C. Preferably, at least about 75%, and more preferably at least about 90%, of the S portion (excluding grafting site components) is derived from ingredients selected from the group consisting of trimethyl cyclohexyl methacrylate; t-butyl methacrylate; n-butyl methacrylate; isobornyl (meth)acrylate; 1,6-Hexanediol di(meth)acrylate and combinations thereof. Toners using copolymers having the above described S portion characteristics exhibit particularly superior performance properties in image quality and transfer as described herein.

Nitrile functionality may be advantageously incorporated into the copolymer for a variety of reasons, including improved durability, enhanced compatibility with visual enhancement additive(s), e.g., colorant particles, and the like. In order to provide a copolymer having pendant nitrile groups, one or more nitrile functional monomers can be used. Representative examples of such monomers include (meth)acrylonitrile, β-cyanoethyl-(meth)acrylate, 2-cyanoethoxyethyl (meth)acrylate, p-cyanostyrene, p-(cyanomethyl)styrene, N-vinylpyrrolidinone, and the like.

In order to provide a copolymer having pendant hydroxyl groups, one or more hydroxyl functional monomers can be used. Pendant hydroxyl groups of the copolymer not only facilitate dispersion and interaction with the pigments in the formulation, but also promote solubility, cure, reactivity with other reactants, and compatibility with other reactants. The hydroxyl groups can be primary, secondary, or tertiary, although primary and secondary hydroxyl groups are preferred. When used, hydroxy functional monomers constitute from about 0.5 to 30, more preferably 1 to about 25 weight percent of the monomers used to formulate the copolymer, subject to preferred weight ranges for graft copolymers noted below.

Representative examples of suitable hydroxyl functional monomers include an ester of an α,β-unsaturated carboxylic acid with a diol, e.g., 2-hydroxyethyl (meth)acrylate, or 2-hydroxypropyl (meth)acrylate; 1,3-dihydroxypropyl-2-(meth)acrylate; 2,3-dihydroxypropyl-1-(meth)acrylate; an adduct of an α,β-unsaturated carboxylic acid with caprolactone; an alkanol vinyl ether such as 2-hydroxyethyl vinyl ether; 4-vinylbenzyl alcohol; allyl alcohol; p-methylol styrene; or the like.

Polymerizable crystallizable compound(s) (PCC's), e.g. crystalline monomer(s), also may be advantageously incorporated into the copolymer in order to improve blocking resistance between printed receptors and to reduce offset during fusing. Polymerizable crystallizable compounds are incorporated into the copolymer by chemical incorporation, e.g., polymerization or copolymerization. The term "crystalline monomer" refers to a monomer whose homopolymeric analog is capable of independently and reversibly crystallizing at or above room temperature (e.g., 22° C.).

In these embodiments, the resulting toner particles can exhibit improved blocking resistance between printed receptors and reduced offset during fusing. If used, one or more of these crystalline monomers may be incorporated into the S and/or D material, but preferably is incorporated into the D material. Suitable crystalline monomers include alkyl (meth)acrylates where the alkyl chain contains more than 13 carbon atoms (e.g. tetradecyl(meth)acrylate, pentadecyl (meth)acrylate, hexadecyl(meth)acrylate, heptadecyl(meth) acrylate, octadecyl(meth)acrylate, etc). Other suitable crystalline monomers whose homopolymers have melting points above 22° C. include aryl acrylates and methacrylates; high molecular weight alpha olefins; linear or branched long chain alkyl vinyl ethers or vinyl esters; long chain alkyl isocyanates; unsaturated long chain polyesters, polysiloxanes and polysilanes; polymerizable natural waxes with melting points above 22° C.; polymerizable synthetic waxes with melting points above 22° C.; and other similar type materials known to those skilled in the art. As described herein, incorporation of crystalline monomers in the copolymer provides surprising benefits to the resulting dry toner particles.

It will be understood by those skilled in the art that blocking resistance can be observed at temperatures above room temperature but below the crystallization temperature of the polymer or copolymer portion incorporating the crystalline monomers or other polymerizable crystallizable compound. Improved blocking resistance is observed when the crystalline monomer is a major component of the S material, preferably greater than or equal to 45%, more preferably greater than or equal to 75%, most preferably greater than or equal to 90% of the S material incorporated into the copolymer.

Many crystalline monomers tend to be soluble in oleophilic solvents commonly used as liquid carrier material(s) in an organosol. Thus, crystalline monomer is relatively easily incorporated into S material without impacting desired solubility characteristics. However, if too much of such crystalline monomer were to be incorporated into D material, the resultant D material may tend to be too soluble in the organosol. Yet, so long as the amount of soluble, crystalline monomer in the D material is limited, some amount of crystalline monomer may be advantageously incorporated into the D material without unduly impacting the desired insolubility characteristics. Thus, when present in the D material, the crystalline monomer is preferably provided in an amount of up to about 30%, more preferably up to about 20%, most preferably up to about 5% to 10% of the total D material incorporated into the copolymer.

When crystalline monomers or PCC's are chemically incorporated into the S material, suitable co-polymerizable compounds that can be used in combination with the PCC include monomers such as other PCC's, 2-ethylhexyl acrylate, 2-ethylhexyl (methacrylate), lauryl acrylate, lauryl methacrylate, octadecyl acrylate, octadecyl(methacrylate), isobornyl acrylate, isobornyl (methacrylate), hydroxy(ethylmethacrylate), other acrylates and methacrylates, combinations of these and the like.

It is also advantageous to incorporate monomers into the copolymer that provide polymerized portions that are inherently triboelectrically charged. When used, it is preferred to incorporate such materials into the S material, as this material tends to be more solvated by the liquid carrier and is therefore located towards the outside surface or shell of the resultant triboelectrically charged toner particles. Monomers that provide polymer portions with positive and/or negative triboelectric charges may be used in amounts effective to produce the desired inherent triboelectric charge characteristics. For instance, butyl methacrylate generally tends to provide a more positive (less negative) triboelectric charge while styrene tends to provide a more negative (less positive) triboelectric charge, particularly when used in combination with other monomers.

Multifunctional free radically reactive materials may also used to enhance one or more properties of the resultant toner particles, including crosslink density, hardness, tackiness, mar resistance, or the like. Examples of such higher functional, monomers include ethylene glycol di(meth)acrylate, hexanediol di(meth)acrylate, triethylene glycol di(meth) acrylate, tetraethylene glycol di(meth)acrylate, trimethylolpropane tri(meth)acrylate, ethoxylated trimethylolpropane tri(meth)acrylate, glycerol tri(meth)acrylate, pentaerythritol tri(meth)acrylate, pentaerythritol tetra(meth)acrylate, and neopentyl glycol di(meth)acrylate, divinyl benzene, combinations of these, and the like.

Suitable free radically reactive oligomer and/or polymeric materials for use in the present invention include, but are not limited to, (meth)acrylated urethanes (i.e., urethane (meth) acrylates), (meth)acrylated epoxies (i.e., epoxy (meth)acrylates), (meth)acrylated polyesters (i.e., polyester (meth)acrylates), (meth)acrylated (meth)acrylics, (meth)acrylated silicones, (meth)acrylated polyethers (i.e., polyether (meth) acrylates), vinyl (meth)acrylates, and (meth)acrylated oils.

Copolymers of the present invention can be prepared by free-radical polymerization methods known in the art, including but not limited to bulk, solution, and dispersion polymerization methods. The resultant copolymers may have a variety of structures including linear, branched, three dimensionally networked, graft-structured, combinations thereof, and the like. A preferred embodiment is a graft copolymer comprising one or more oligomeric and/or polymeric arms attached to an oligomeric or polymeric backbone. In graft copolymer embodiments, the S portion or D portion materials, as the case may be, may be incorporated into the arms and/or the backbone.

Any number of reactions known to those skilled in the art may be used to prepare a free radically polymerized copolymer having a graft structure. Common grafting methods include random grafting of polyfunctional free radicals; copolymerization of monomers with macromonomers; ring-opening polymerizations of cyclic ethers, esters, amides or acetals; epoxidations; reactions of hydroxyl or amino chain transfer agents with terminally-unsaturated end groups; esterification reactions (i.e., glycidyl methacrylate undergoes tertiary-amine catalyzed esterification with methacrylic acid); and condensation polymerization.

Representative methods of forming graft copolymers are described in U.S. Pat. Nos. 6,255,363; 6,136,490; and 5,384,226; and Japanese Published Patent Document No. 05-119529, incorporated herein by reference. Representative examples of grafting methods are also described in sections 3.7 and 3.8 of Dispersion Polymerization in Organic Media, K. E. J. Barrett, ed., (John Wiley; New York, 1975) pp. 79–106, also incorporated herein by reference.

Representative examples of grafting methods also may use an anchoring group to facilitate anchoring. The function of the anchoring group is to provide a covalently bonded link between the core part of the copolymer (the D material) and the soluble shell component (the S material). Suitable monomers containing anchoring groups include: adducts of alkenylazlactone comonomers with an unsaturated nucleophile containing hydroxy, amino, or mercaptan groups, such as 2-hydroxyethylmethacrylate, 3-hydroxypropylmethacrylate, 2-hydroxyethylacrylate, pentaerythritol triacrylate, 4-hydroxybutylvinylether, 9-octadecen-1-ol, cinnamyl alcohol, allyl mercaptan, methallylamine; and azlactones, such as 2-alkenyl-4,4-dialkylazlactone.

The preferred methodology described below accomplishes grafting via attaching an ethylenically-unsaturated isocyanate (e.g. dimethyl-m-isopropenyl benzylisocyanate, TMI, available from CYTEC Industries, West Paterson, N.J.; or isocyanatoethyl methacrylate, also known as IEM) to hydroxyl groups in order to provide free radically reactive anchoring groups.

A preferred method of forming a graft copolymer of the present invention involves three reaction steps that are carried out in a suitable substantially nonaqueous liquid carrier in which resultant S material is soluble while D material is dispersed or insoluble. In a first preferred step, a hydroxyl functional, free radically polymerized oligomer or polymer is formed from one or more monomers, wherein at least one of the monomers has pendant hydroxyl functionality. Preferably, the hydroxyl functional monomer constitutes about 1 to about 30, preferably about 2 to about 10 percent, most preferably 3 to about 5 percent by weight of the monomers used to form the oligomer or polymer of this first step. This first step is preferably carried out via solution polymerization in a substantially nonaqueous solvent in which the monomers and the resultant polymer are soluble. For instance, using the Hildebrand solubility data in Table 1, monomers such as octadecyl methacrylate, octadecyl acrylate, lauryl acrylate, and lauryl methacrylate are suitable for this first reaction step when using an oleophilic solvent such as heptane or the like.

In a second reaction step, all or a portion of the hydroxyl groups of the soluble polymer are catalytically reacted with an ethylenically unsaturated aliphatic isocyanate (e.g. meta-isopropenyldimethylbenzyl isocyanate commonly known as TMI or isocyanatoethyl methacrylate, commonly known as IEM) to form pendant free radically polymerizable functionality which is attached to the oligomer or polymer via a polyurethane linkage. This reaction can be carried out in the same solvent, and hence the same reaction vessel, as the first step. The resultant double-bond functionalized polymer generally remains soluble in the reaction solvent and constitutes the S portion material of the resultant copolymer, which ultimately will constitute at least a portion of the solvatable portion of the resultant triboelectrically charged particles.

The resultant free radically reactive functionality provides grafting sites for attaching D material and optionally additional S material to the polymer. In a third step, these grafting site(s) are used to covalently graft such material to the polymer via reaction with one or more free radically reactive monomers, oligomers, and or polymers that are initially soluble in the solvent, but then become insoluble as the molecular weight of the graft copolymer increases. For instance, using the Hildebrand solubility parameters in Table 1, monomers such as e.g. methyl (meth)acrylate, ethyl (meth)acrylate, t-butyl methacrylate and styrene are suitable for this third reaction step when using an oleophilic solvent such as heptane or the like.

The product of the third reaction step is generally an organosol comprising the resultant copolymer dispersed in the reaction solvent, which constitutes a substantially nonaqueous liquid carrier for the organosol. At this stage, it is believed that the copolymer tends to exist in the liquid carrier as discrete, monodisperse particles having dispersed (e.g., substantially insoluble, phase separated) portion(s) and solvated (e.g., substantially soluble) portion(s). As such, the solvated portion(s) help to sterically-stabilize the dispersion of the particles in the liquid carrier. It can be appreciated that the copolymer is thus advantageously formed in the liquid carrier in situ.

Before further processing, the copolymer particles may remain in the reaction solvent. Alternatively, the particles may be transferred in any suitable way into fresh solvent that is the same or different so long as the copolymer has solvated and dispersed phases in the fresh solvent. In either case, the resulting organosol is then converted into toner particles by preferably mixing the organosol with at least one visual enhancement additive. Optionally, one or more other desired ingredients also can be mixed into the organosol before and/or after combination with the visual enhancement particles. During such combination, it is believed that ingredients comprising the visual enhancement additive and the copolymer will tend to self-assemble into composite particles having a structure wherein the dispersible phase portions generally tend to associate with the visual enhancement additive particles (for example, by physically and/or chemically interacting with the surface of the particles), while the solvatable phase portions help promote dispersion in the carrier. The dispersion is then dried to the desired degree to provide composite particles that have dry toner functionality.

The manner in which the dispersion is dried may impact the degree to which the resultant toner particles may be agglomerated and/or aggregated. In preferred modes of practice, the particles are dried while fluidized, aspirated, suspended, or entrained (collectively "fluidized") in a carrier gas to minimize aggregation and/or agglomeration of the dry toner particles as the particles dry. In practical effect, the fluidized particles are dried while in a low density condition. This minimizes interparticle collisions, allowing particles to dry in relative isolation from other particles. Such fluidizing may be achieved using vibration energy, electrostatic energy, a moving gas, combinations of these, and the like. The carrier gas may comprise one or more gases that may be generally inert (e.g. nitrogen, air, carbon dioxide, argon, or the like). Alternatively, the carrier gas may include one or more reactive species. For instance, an oxidizing and/or reducing species may be used if desired. Advantageously, the product of fluidized drying constitutes free flowing dry toner particles with a narrow particle size distribution.

As one example of using a fluidized bed dryer, the liquid toners may be filtered or centrifuged to form a wet cake. The wet filter cake may be placed into the conical drying chamber of a fluid bed dryer (such as that available from Niro Aeromatic, Niro Corp., Hudson, Wis.). Ambient air at about 35–50° C., or preferably lower than the $T_g$ of the copolymer, may be passed through the chamber (from bottom to top) with a flow rate sufficient to loft any dried powder and to keep the powder airborne inside the vessel (i.e., a fluidized powder bed). The air may be heated or otherwise pretreated. Bag filters in the vessel allow the air to leave the drying vessel while keeping the powder contained. Any toner that accumulates on the filter bags may be blown down by a periodic reverse air flow through the filters. Samples may be dried anywhere from 10–20 minutes to several hours, depending on the nature of the solvent (e.g. boiling point), the initial solvent content, and the drying conditions.

Advantageously, the S material of the copolymer serves as a graft stabilizer, chemically bonded steric stabilizer, or internal dispersant for the toner particles in the fluidized state. Consequently, although separate dispersant material could be used to help mix the dry toner ingredients together, the use of a separate dispersant material is not needed, or even desirable, in preferred embodiments. Separate dispersants are less desirable as these tend to be humidity sensitive, and may migrate from the toner particles during printing. Dry toner particles incorporating separate dispersant material may tend to have charging characteristics that vary with humidity changes. By avoiding separate dispersant material, it is believed that preferred embodiments of the present invention would show more stable charging characteristics with changes in humidity.

The optional visual enhancement additive(s) generally may include any one or more fluid and/or particulate materials that provide a desired visual effect when toner particles incorporating such materials are printed onto a receptor. Examples include one or more colorants, fluorescent materials, pearlescent materials, iridescent materials, metallic materials, flip-flop pigments, silica, polymeric beads, reflective and non-reflective glass beads, mica, combinations of these, and the like. The amount of visual enhancement additive incorporated into the toner particles may vary over a wide range. In representative embodiments, a suitable weight ratio of copolymer to visual enhancement additive is from 1/1 to 20/1, preferably from 2/1 to 10/1 and most preferably from 4/1 to 8/1.

Useful colorants are well known in the art and include materials listed in the Colour Index, as published by the Society of Dyers and Colourists (Bradford, England), including dyes, stains, and pigments. Preferred colorants are pigments which may be combined with ingredients comprising the copolymer to interact with the D portion of the copolymer to form dry toner particles with structure as described herein, are at least nominally insoluble in and nonreactive with the carrier liquid, and are useful and effective in making visible the latent electrostatic image. It is understood that the visual enhancement additive(s) may also interact with each other physically and/or chemically, forming aggregations and/or agglomerates of visual enhancement additives that also interact with the D portion of the copolymer. Examples of suitable colorants include: phthalocyanine blue (C.I. Pigment Blue 15:1, 15:2, 15:3 and 15:4), monoarylide yellow (C.I. Pigment Yellow 1, 3, 65, 73 and 74), diarylide yellow (C.I. Pigment Yellow 12, 13, 14, 17 and 83), arylamide (Hansa) yellow (C.I. Pigment Yellow 10, 97, 105 and 111), isoindoline yellow (C.I. Pigment Yellow 138), azo red (C.I. Pigment Red 3, 17, 22, 23, 38, 48:1, 48:2, 52:1, and 52:179), quinacridone magenta (C.I. Pigment Red 122, 202 and 209), laked rhodamine magenta (C.I. Pigment Red 81:1, 81:2, 81:3, and 81:4), and black pigments such as finely divided carbon (Cabot Monarch 120, Cabot Regal 300R, Cabot Regal 350R, Vulcan X72, and Aztech ED 8200), and the like.

In addition to the visual enhancement additive, other additives optionally may be formulated into the triboelectrically charged particle formulation. A particularly preferred additive comprises at least one charge control additive (charge control agent, CCA). The charge control additive, also known as a charge director, helps to provide uniform charge polarity of the toner particles. The charge director may be incorporated into the toner particles using a variety of methods such as, copolymerizing a suitable monomer with the other monomers used to form the copolymer, chemically reacting the charge director with the toner particle, chemically or physically adsorbing the charge director onto the toner particle (resin or pigment), or chelating the charge director to a functional group incorporated into the toner particle. A preferred method is via a functional group built into the S material of the copolymer.

It is preferable to use a triboelectric charge control additive that may be included as a separate ingredient and/or included as one or more functional moiety(ies) of S and/or D material incorporated into the amphipathic copolymer. The triboelectric charge control additive is used to enhance the chargeability of the toner. The triboelectric charge control agent may have either a negative or a positive electric charge. As representative examples of the triboelectric charge control additive, there can be mentioned nigrosine NO1 (produced by Orient Chemical Co.), nigrosine EX (produced by Orient Chemical Co.), Aizen Spilon black TRH (produced by Hodogaya Chemical Co.), T-77 (produced by Hodogaya Chemical Co.), Bontron S-34 (produced by Orient Chemical Co.), and Bontron E-84 (produced by Orient Chemical Co.). The amount of the triboelectric charge control additive, based on 100 parts by weight of the toner solids, is generally 0.01 to 10 parts by weight, preferably 0.1 to 5 parts by weight.

Other additives may also be added to the formulation in accordance with conventional practices. These include one or more of UV stabilizers, mold inhibitors, bactericides, fungicides, antistatic agents, gloss modifying agents, other polymer or oligomer material, antioxidants, anticaking agents such as silane or silicone-modified silica particles (typically 5 to 50 nm particle size), combinations of these, and the like.

The particle size of the resultant triboelectrically charged toner particles may impact the imaging, fusing, resolution, and transfer characteristics of the toner incorporating such particles. Preferably, the volume mean particle diameter (determined by laser diffraction light scattering) of the toner particles is in the range of about 0.5 to about 30.0 microns, more preferably in the range of about 1 to about 15 microns, most preferably in the range of about 3 to about 10 microns.

In electrophotographic and electrographic processes, an electrostatic image is formed on the surface of a photoreceptive element or dielectric element, respectively. The photoreceptive element or dielectric element may be an intermediate transfer drum or belt or the substrate for the final toned image itself, as described by Schmidt, S. P. and Larson, J. R. in Handbook of Imaging Materials Diamond, A. S., Ed: Marcel Dekker: New York; Chapter 6, pp 227–252, and U.S. Pat. Nos. 4,728,983; 4,321,404; and 4,268,598.

In electrography, a latent image is typically formed by (1) placing a charge image onto the dielectric element (typically the receiving substrate) in selected areas of the element with an electrostatic writing stylus or its equivalent to form a charge image, (2) applying toner to the charge image, and (3) fixing the toned image. An example of this type of process is described in U.S. Pat. No. 5,262,259. Images formed by the present invention may be of a single color or a plurality of colors. Multicolor images can be prepared by repetition of the charging and toner application steps.

In electrophotography, the electrostatic image is typically formed on a drum or belt coated with a photoreceptive element by (1) uniformly charging the photoreceptive element with an applied voltage, (2) exposing and discharging portions of the photoreceptive element with a radiation source to form a latent image, (3) applying a toner to the latent image to form a toned image, and (4) transferring the toned image through one or more steps to a final receptor sheet. In some applications, it is sometimes desirable to fix the toned image using a heated pressure roller or other fixing methods known in the art.

While the electrostatic charge of either the toner particles or photoreceptive element may be either positive or negative, electrophotography as employed in the present invention is preferably carried out by dissipating charge on a positively charged photoreceptive element. A positively-charged toner is then applied to the regions in which the positive charge was dissipated using a dry toner development technique.

The substrate for receiving the image from the photoreceptive element can be any commonly used receptor material, such as paper, coated paper, polymeric films and primed or coated polymeric films. Polymeric films include polyesters and coated polyesters, polyolefins such as polyethylene or polypropylene, plasticized and compounded polyvinyl chloride (PVC), acrylics, polyurethanes, polyethylene/acrylic acid copolymer, and polyvinyl butyrals. The polymer film may be coated or primed, e.g. to promote toner adhesion.

These and other aspects of the present invention are demonstrated in the illustrative examples that follow.

EXAMPLES

Test Methods and Apparatus

In the following examples, percent solids of the copolymer solutions and the organosol and ink dispersions were determined gravimetrically using the Halogen Lamp Drying Method using a halogen lamp drying oven attachment to a precision analytical balance (Mettler Instruments, Inc., Highstown, N.J.). Approximately two grams of sample were used in each determination of percent solids using this sample dry down method.

In the practice of the invention, molecular weight is normally expressed in terms of the weight average molecular weight, while molecular weight polydispersity is given by the ratio of the weight average molecular weight to the number average molecular weight. Molecular weight parameters were determined with gel permeation chromatography (GPC) using tetrahydrofuran as the carrier solvent. Absolute weight average molecular weight were determined using a Dawn DSP-F light scattering detector (Wyatt Technology Corp., Santa Barbara, Calif.), while polydispersity was evaluated by ratioing the measured weight average molecular weight to a value of number average molecular weight determined with an Optilab 903 differential refractometer detector (Wyatt Technology Corp., Santa Barbara, Calif.).

Organosol and toner particle size distributions were determined by a Laser Diffraction Method using a Horiba LA-900 laser diffraction particle size analyzer (Horiba Instruments, Inc., Irvine, Calif.). Samples were diluted approximately 1/500 by volume and sonicated for one minute at 150 watts and 20 kHz prior to measurement. Particle size was expressed as both a number mean diameter ($D_n$) and a volume mean diameter ($D_v$) and in order to provide an indication of both the fundamental (primary) particle size and the presence of aggregates or agglomerates.

One important characteristic of xerographic toners is the toner's electrostatic charging performance (or specific charge), given in units of Coulombs per gram. The specific charge of each toner was established in the examples below using a blow-off tribo-tester instrument (Toshiba Model TB200, Toshiba Chemical Co., Tokyo, Japan). To use this device, the toner is first electrostatically charged by combining it with a carrier powder. The latter usually is a ferrite powder coated with a polymeric shell. The toner and the coated carrier particles are brought together to form the developer. When the developer is gently agitated, tribo-charging results in both of the component powders acquiring an equal and opposite electrostatic charge, the magnitude of which is determined by the properties of the toner, along with any compounds deliberately added to the toner to affect the charging (e.g., charge control agents).

Once charged, the developer mixture is placed in a small holder inside the blow-off tribo-tester. The holder acts a charge-measuring Faraday cup, attached to a sensitive capacitance meter. The cup has a connection to a compressed nitrogen line and a fine screen at its base, sized to retain the larger carrier particles while allowing the smaller toner particles to pass. When the gas line is pressurized, gas flows thought the cup and forces the toner particles out of the cup through the fine screen. The carrier particles remain in the Faraday cup. The capacitance meter in the tester measures the charge of the carrier; the charge on the toner that was removed is equal in magnitude and opposite in sign. A measurement of the amount of toner mass lost yields the toner specific charge, in microCoulombs per gram.

For the present measurements, a silicon coated ferrite carrier (Vertex Image Systems Type 2) with a mean particle size of about 80–100 microns was used. Toner was added to the carrier powder to obtain a 3 weight percent toner content in the developer. This developer was gently agitated on a roller table for at least 45 minutes before blow-off testing. Specific charge measurements were repeated at least five times for each toner to obtain a mean value and a standard deviation. Tests were considered valid if the amount of toner mass lost during the blow-off was between 50 and 100% of the total toner content expected in each sample. Tests with mass losses outside of these values were rejected.

Materials

The following abbreviations are used in the examples:

BHA: Behenyl acrylate (a PCC available from Ciba Specialty Chemical Co., Suffolk, Va.)

BMA: Butyl methacrylate (available from Aldrich Chemical Co., Milwaukee, Wis.)

EMA: Ethyl methacrylate (available from Aldrich Chemical Co., Milwaukee, Wis.)

Exp 61: Amine-functional silicone wax (a PCC available from Genesee Polymer Corporation, Flint, Mich.)

HEMA: 2-Hydroxyethyl methacrylate (available from Aldrich Chemical Co., Milwaukee, Wis.)

LMA: Lauryl methacrylate (available from Aldrich Chemical Co., Milwaukee, Wis.)

ODA: Octadecyl acrylate (a PCC available Aldrich Chemical Co., Milwaukee, Wis.)

TCHMA: Trimethyl cyclohexyl methacrylate (available from Ciba Specialty Chemical Co., Suffolk, Va.)

St: Styrene (available from Aldrich Chemical Co., Milwaukee, Wis.)

TMI: Dimethyl-m-isopropenyl benzyl isocyanate (available from CYTEC Industries, West Paterson, N.J.)

AIBN: Azobisisobutyronitrile (an initiator available as VAZO-64 from DuPont Chemical Co., Wilmington, Del.)

V-601: Dimethyl 2,2'-azobisisobutyrate (an initiator available as V-601 from WAKO Chemicals U.S.A., Richmond, Va.)

DBTDL: Dibutyl tin dilaurate (a catalyst available from Aldrich Chemical Co., Milwaukee, Wis.)

Zirconium HEX-CEM: (metal soap, zirconium octoate, available from OMG Chemical Company, Cleveland, Ohio)

Nomenclature

In the following examples, the compositional details of each copolymer will be summarized by ratioing the weight percentages of monomers used to create the copolymer. The grafting site composition is expressed as a weight percentage of the monomers comprising the copolymer or copolymer precursor, as the case may be. For example, a graft stabilizer (precursor to the S portion of the copolymer) is designated TCHMA/HEMA-TMI (97/3-4.7) is made by copolymerizing, on a relative basis, 97 parts by weight TCHMA and 3 parts by weight HEMA, and this hydroxy functional polymer was reacted with 4.7 parts by weight of TMI.

Similarly, a graft copolymer organosol designated TCHMA/HEMA-TMI//EMA (97-3-4.7//100) is made by copolymerizing the designated graft stabilizer (TCHMA-TMI (97/3-4.7)) (S portion or shell) with the designated core monomer EMA (D portion or core) at a specified ratio of D/S (core/shell) determined by the relative weights reported in the examples.

Preparation of Copolymer S Materials, also Referred to Herein as "Graft Stabilizers"

Example 1

A 5000 ml 3-neck round flask equipped with a condenser, a thermocouple connected to a digital temperature controller, a nitrogen inlet tube connected to a source of dry nitrogen and a magnetic stirrer, was charged with a mixture of 2561 g of Heptane, 849 g of TCHMA, 26.8 g of 98% HEMA and 8.31 g of V-601. While stirring the mixture, the reaction flask was purged with dry nitrogen for 30 minutes at flow rate of approximately 2 liters/minute. A hollow glass stopper was then inserted into the open end of the condenser and the nitrogen flow rate was reduced to approximately 0.5 liters/minute. The mixture was heated to 70° C. for 16 hours. The conversion was quantitative.

The mixture was heated to 90° C. and held at that temperature for 1 hour to destroy any residual V-601, then was cooled back to 70° C. The nitrogen inlet tube was then removed, and 13.6 g of 95% DBTDL were added to the mixture, followed by 41.1 g of TMI. The TMI was added drop wise over the course of approximately 5 minutes while stirring the reaction mixture. The nitrogen inlet tube was replaced, the hollow glass stopper in the condenser was removed, and the reaction flask was purged with dry nitrogen for 30 minutes at a flow rate of approximately 2 liters/minute. The hollow glass stopper was reinserted into the open end of the condenser and the nitrogen flow rate was reduced to approximately 0.5 liters/minute. The mixture was allowed to react at 70° C. for 6 hours, at which time the conversion was quantitative.

The mixture was then cooled to room temperature. The cooled mixture was a viscous, transparent liquid containing no visible insoluble matter. The percent solids of the liquid mixture was determined to be 28.86% using the Halogen Lamp Drying Method described above. Subsequent determination of molecular weight was made using the GPC method described above; the copolymer had a $M_w$ of 301,000 Da and $M_w/M_n$ of 3.3 based on two independent measurements. The product is a copolymer of TCHMA and HEMA containing random side chains of TMI and is designated herein as TCHMA/HEMA-TMI (97/3-4.7% w/w) and suitable for making an organosol.

Example 2

Using the method and apparatus of Example 1, 2561 g of Norpar™ 12, 849 g of BHA, 26.8 g of 98% HEMA and 8.31 g of V-601 were combined and resulting mixture reacted at 70° C. for 16 hours. The mixture was then heated to 90° C. for 1 hour to destroy any residual V-601, then was cooled back to 70° C. To the cooled mixture was then added 13.6 g of 95% DBTDL and 41.1 g of TMI. The TMI was added drop wise over the course of approximately 5 minutes while stirring the reaction mixture. Following the procedure of Example 1, the mixture was reacted at 70° C. for approximately 6 hours at which time the reaction was quantitative. The mixture was then cooled to room temperature. The cooled mixture was viscous, transparent solution, containing no visible insoluble matter.

The percent solids of the liquid mixture was determined to be 26.25% using the Halogen Lamp Drying Method described above. Subsequent determination of molecular weight was made using the GPC method described above; the copolymer had a $M_w$ of 248,650 Da and $M_w/M_n$ of 2.9 based upon two independent measurements. The product is a copolymer of BHA and HEMA containing random side chains of TMI, is designated herein as BHA/HEMA-TMI (97/3-4.7% w/w), and is suitable for making an organosol incorporating a chemically-bonded PCC (BHA) in the S portion of the copolymer.

Example 3

Using the method and apparatus of Example 1, 2561 g of Norpar™ 12, 849 g of ODA, 26.8 g of 98% HEMA and 8.31 g of V-601 were combined and resulting mixture reacted at 70° C. for 16 hours. The mixture was then heated to 90° C. for 1 hour to destroy any residual V-601, then was cooled back to 70° C. To the cooled mixture was then added 13.6 g of 95% DBTDL and 41.1 g of TMI. The TMI was added drop wise over the course of approximately 5 minutes while stirring the reaction mixture. Following the procedure of Example 1, the mixture was reacted at 70° C. for approximately 6 hours at which time the reaction was quantitative. The mixture was then cooled to room temperature. The cooled mixture was viscous, transparent solution, containing no visible insoluble matter.

The percent solids of the liquid mixture was determined to be 26.21% using the Halogen Lamp Drying Method described above. Subsequent determination of molecular weight was made using the GPC method described above; the copolymer had a $M_w$ of 213,600 Da and $M_w/M_n$ of 1.5 based upon two independent measurements. The product is a copolymer of ODA and HEMA containing random side chains of TMI, is designated herein as ODA/HEMA-TMI (97/3-4.7% w/w), and is suitable for making an organosol incorporating a chemically-bonded PCC (ODA) in the S portion of the copolymer.

The compositions of the graft stabilizers of Examples 1, 2, and 3 are summarized in the following table:

TABLE 2

| Example Number | Graft Stabilizer Composition (% w/w) | Calculated Stabilizer $T_g$* (° C.) | Solids (% w/w) | Molecular Weight $M_w$(Da) | $M_w/M_n$ |
|---|---|---|---|---|---|
| | Graft Stabilizers (S portion) | | | | |
| 1 | TCHMA/HEMA-TMI (97/3-4.7) | 125 | 28.86 | 301,000 | 3.3 |
| 2 | BHA/HEMA-TMI (97/3-4.7) | <−55 | 26.25 | 248,650 | 2.9 |
| 3 | ODA/HEMA-TMI (97/3-4.7) | −55 | 26.21 | 213,600 | 1.5 |

*Excluding HEMA-TMI grafting site

Examples 4–8

Addition of D Material to Form Graft Copolymer Organosols:

Example 4

This is an example using the graft stabilizer in Example 1 to prepare an organosol comprising a copolymer that can be used to prepare a dry toner. A 5000 ml 3-neck round flask equipped with a condenser, a thermocouple connected to a digital temperature controller, a nitrogen inlet tube connected to a source of dry nitrogen and a magnetic stirrer, was charged with a mixture of 2534 g of Heptane, 528 g of EMA, 229 g of the graft stabilizer mixture from Example 1 @28.86% polymer solids, and 8.9 g of V-601. While stirring the mixture, the reaction flask was purged with dry nitrogen for 30 minutes at flow rate of approximately 2 liters/minute. A hollow glass stopper was then inserted into the open end of the condenser and the nitrogen flow rate was reduced to approximately 0.5 liters/minute. The mixture was heated to 70° C. for 16 hours. The conversion was quantitative.

The resulting mixture was stripped of residual monomer using a rotary evaporator equipped with a dry ice/acetone condenser and operating at a temperature of 90° C. and a vacuum of approximately 15 mm Hg. The stripped organosol was cooled to room temperature, yielding an opaque white dispersion.

This organosol is designated TCHMA/HEMA-TMI//EMA (97/3-4.7//00% w/w). The percent solids of the organosol dispersion after stripping was determined as 22.49% using Halogen Lamp Drying Method described above. Subsequent determination of average particles size was made using Laser Diffraction Method described above; the organosol had a volume average diameter of 0.47 μm. The $T_g$ of the copolymer was 71° C. as calculated using the Fox Equation, suitable for preparing a dry toner.

Example 5

This is an example using the graft stabilizer in Example 1 to prepare an organosol, that can be used as the binder for a dry toner. Using the method and apparatus of Example 4, 2639 g of Heptane, 540 g of Styrene, 312 g of the graft stabilizer mixture from Example 1 @28.86% polymer solids, and 9.45 g of V-601 were combined. The mixture was heated to 70° C. for 16 hours. The conversion was quantitative. The mixture then was cooled to room temperature. After stripping the organosol using the method of Example 4 to remove residual monomer, the stripped organosol was cooled to room temperature, yielding an opaque white dispersion. This organosol is designated TCHMA/HEMA-TMI//St (97/3-4.7//00% w/w) and can be used to prepare a dry toner. The percent solids of the organosol dispersion after stripping was determined as 13.67% using Halogen Lamp Drying Method described above. Subsequent determination of average particles size was made using the Laser Diffraction Method described above; the organosol had a volume average diameter of 7.9 μm. The $T_g$ of the copolymer was 103° C. as calculated using the Fox Equation, suitable for preparing a dry toner.

Example 6

This is an example using the graft stabilizer in Example 2 to prepare an organosol that contains a PCC in the S portion of the copolymer. Using the method and apparatus of Example 4, 2838 g of Norpar™ 12, 336 g of EMA, 320 g of the graft stabilizer mixture from Example 2 @26.25% polymer solids, and 6.30 g of V-601 were combined. The mixture was heated to 70° C. for 16 hours. The conversion was quantitative. The mixture then was cooled to room temperature. After stripping the organosol using the method of Example 4 to remove residual monomer, the stripped organosol was cooled to room temperature, yielding an opaque white dispersion. This organosol is designated BHA/HEMA-TMI//EMA (97/3-4.7//100% w/w) and can be used to prepare a dry toner. The percent solids of the organosol dispersion after stripping was determined as 11.79% using Halogen Lamp Drying Method described above. Subsequent determination of average particles size was made using the Laser Diffraction Method described above; the organosol had a volume average diameter of 41.4 μm. The $T_g$ of the copolymer is below 65° C. as calculated using the Fox Equation; however, the copolymer incorporates a chemically bonded PCC, and is suitable for preparing a dry toner.

Example 7

This is an example using the graft stabilizer in Example 2 to prepare an organosol that contains a PCC in the S portion of the copolymer. Using the method and apparatus of Example 4, 2838 g of Norpar™ 12, 336 g of Styrene, 320 g of the graft stabilizer mixture from Example 2 @26.25% polymer solids, and 6.30 g of V-601 were combined. The mixture was heated to 70° C. for 16 hours. The conversion was quantitative. The mixture then was cooled to room temperature. After stripping the organosol using the method of Example 4 to remove residual monomer, the stripped organosol was cooled to room temperature, yielding an opaque white dispersion. This organosol is designated BHA/HEMA-TMI//St (97/3-4.7//100% w/w) and can be used to prepare a dry toner. The percent solids of the organosol dispersion after stripping was determined as 12.00% using Halogen Lamp Drying Method described above. Subsequent determination of average particles size was made using the Laser Diffraction Method described above; the organosol had a volume average diameter of 1.2 μm. The $T_g$ of the copolymer is below 65° C. as calculated using the Fox Equation; however, the copolymer incorporates a chemically bonded PCC, and is suitable for preparing a dry toner.

Example 8

This is an example using the graft stabilizer in Example 3 to prepare an organosol that contains a PCC in the S portion of the copolymer. Using the method and apparatus of Example 4, 2837 g of Norpar™ 12, 336 g of BMA, 320 g of the graft stabilizer mixture from Example 3 @ 26.21% polymer solids, and 6.30 g of V-601 were combined. The mixture was heated to 70° C. for 16 hours. The conversion was quantitative. The mixture then was cooled to room temperature. After stripping the organosol using the method of Example 4 to remove residual monomer, the stripped organosol was cooled to room temperature, yielding an opaque white dispersion. This organosol is designated ODA/HEMA-TMI//BMA (97/3-4.7/1100% w/w) and can be used to prepare a dry toner. The percent solids of the organosol dispersion after stripping was determined as 11.69% using Halogen Lamp Drying Method described above. Subsequent determination of average particles size was made using the Laser Diffraction Method described above; the organosol had a volume average diameter of 1.1 μm. The $T_g$ of the copolymer is 8° C. as calculated using the Fox Equation; however, the copolymer incorporates a chemically bonded PCC, and is suitable for preparing a dry toner.

Example 9

This is an example using the graft stabilizer in Example 3 to prepare an organosol which contains a PCC in the S portion of the copolymer. Using the method and apparatus of Example 4, 2837 g of Norpar™ 12, 336 g of EMA, 320 g of the graft stabilizer mixture from Example 3 @ 26.21% polymer solids, and 6.30 g of V-601 were combined. The mixture was heated to 70° C. for 16 hours. The conversion was quantitative. The mixture then was cooled to room temperature. After stripping the organosol using the method of Example 4 to remove residual monomer, the stripped organosol was cooled to room temperature, yielding an opaque white dispersion. This organosol is designated ODA/HEMA-TMI//EMA (97/3-4.7//100% w/w) and can be used to prepare a dry toner. The percent solids of the organosol dispersion after stripping was determined as 13.76% using Halogen Lamp Drying Method described above. Subsequent determination of average particles size was made using the Laser Diffraction Method described above; the organosol had a volume average diameter of 45.6 μm. The $T_g$ of the copolymer is 43° C. as calculated using the Fox Equation; however, the copolymer incorporates a chemically bonded PCC, and is suitable for preparing a dry toner.

Example 10

This is an example using a silicone wax as the graft stabilizer to prepare an organosol which contains a PCC in the S portion of the copolymer. Using the method and apparatus of Example 4, 3066 g of Norpar™ 12, 84 g of Silicone Wax (Exp61 from Genesee Polymers Corporation), and 8.4 g of TMI were mixed and heated to 45° C. for 6 hours. Then 336 g of EMA and 6.30 g of V-601 were added. The mixture was heated to 70° C. for 16 hours. The conversion was quantitative. The mixture then was cooled to room temperature. After stripping the organosol using the method of Example 4 to remove residual monomer, the stripped organosol was cooled to room temperature, yielding an opaque white dispersion. This organosol was designated Exp 61-TMI//EMA (91-9//100%/w/w) and can be used to prepare a dry toner. The percent solids of the organosol dispersion after stripping was determined as 14.17% using the Halogen Lamp Drying Method described above. Subsequent determination of average particles size was made using the Laser Diffraction Method described above; the organosol had a volume average diameter of 1.8 μm. The $T_g$ of the copolymer is below 65° C. as calculated using the Fox Equation; however, the copolymer incorporates a chemically bonded PCC, and is suitable for preparing a dry toner.

The compositions of the organosol copolymers formed in Examples 4–10 are summarized in the following table:

TABLE 3

Organosol Copolymers

| Example Number | Organosol Copolymer Composition (% w/w) | Calculated Core (D Portion) $T_g$ (° C.) | Calculated Copolymer $T_g$ (° C.) |
|---|---|---|---|
| 4 | TCHMA/HEMA-TMI//EMA (97/3-4.7//100) | 65 | 71 |
| 5 | TCHMA/HEMA-TMI//St (97/3-4.7//100) | 100 | 103 |
| 6 | BHA/HEMA-TMI//EMA (97/3-4.7//100) | 65 | * |
| 7 | BHA/HEMA-TMI//St (97/3-4.7//100) | 100 | * |
| 8 | ODA/HEMA-TMI//BMA (97/3-4.7//100) | 20 | 8 |
| 9 | ODA/HEMA-TMI//EMA (97/3-4.7//100) | 65 | 43 |
| 10 | Exp61-TMI//EMA (91-9//100) | 65 | * |

*Not calculated, contains BHA or Exp61 PCC

Examples 11–22

Dry Toners Containing Copolymers Derived From Organosols

Example 11

This is an example of preparing a Black toner at a weight ratio of organosol copolymer to pigment of 8.5 using the organosol prepared in Example 4, for which the weight ratio of D material to S material was 8.190 g of the organosol @ 22.49% (w/w) solids in Heptane were combined with 105 g of Heptane, 5 g of Black Pigment EK8200 (Magruder Color Company, Tucson, Ariz.) in an 8 ounce glass jar. This mixture was then milled in a 0.5 liter vertical bead mill (Model 6TSG-1/4, Amex Co., Ltd., Tokyo, Japan) charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber. The resultant liquid toner was centrifuged at 7500 RPM for 1 hour, and then the sediment was collected in a tray and dried at 50° C. for 24 hours. The dried toner was ground using a mortar and pestle for approximately 30 minutes.

Example 12

This is an example of preparing a Black toner at a weight ratio of organosol copolymer to pigment of 8.5 using the organosol prepared in Example 4, for which the weight ratio of D material to S material was 8.190 g of the organosol @ 22.49% (w/w) solids in Heptane were combined with 105 g of Heptane, 5 g of Black Pigment Monarch 120 (Cabot Corporation, Billerica, Mass.) in an 8 ounce glass jar. This mixture was then milled in a 0.5 liter vertical bead mill (Model 6TSG-1/4, Amex Co., Ltd., Tokyo, Japan) charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber. The resultant liquid toner was centrifuged at 7500 RPM for 1 hour, and then the sediment was collected in a tray and dried at 50° C. for 24 hours. The dried toner was ground using a mortar and pestle for approximately 30 minutes.

Example 13

This is an example of preparing a Black toner at a weight ratio of organosol copolymer to pigment of 8.5 using the organosol prepared in Example 4, for which the weight ratio of D material to S material was 8.190 g of the organosol @ 22.49% (w/w) solids in Heptane were combined with 105 g of Heptane, 5 g of Black Pigment Regal 300R (Cabot Corporation, Billerica, Mass.) in an 8 ounce glass jar. This mixture was then milled in a 0.5 liter vertical bead mill (Model 6TSG-1/4, Amex Co., Ltd., Tokyo, Japan) charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber. The resultant liquid toner was centrifuged at 7500 RPM for 1 hour, and then the sediment was collected in a tray and dried at 50° C. for 24 hours. The dried toner was ground using a mortar and pestle for approximately 30 minutes.

Example 14

This is an example of preparing a Black toner at a weight ratio of organosol copolymer to pigment of 8 using the organosol prepared in Example 6, for which the weight ratio of D material to S material was 4.271 g of the organosol @ 11.79% (w/w) solids in Norpar™ 12 were combined with 25 g of Norpar™ 12, 4 g of Black Pigment EK8575P (Magruder Color Company, Tucson, Ariz.) and 0.4 g of charging agent Copy Blue PR (Clariant Corporation, Coventry, R.I.) in an 8 ounce glass jar. This mixture was then milled in a 0.5 liter vertical bead mill (Model 6TSG-1/4, Amex Co., Ltd., Tokyo, Japan) charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber. The resultant liquid toner was centrifuged at 7500 RPM for 1 hour, and then the sediment was collected in a tray and dried at 50° C. for 24 hours. The dried toner was ground using a mortar and pestle for approximately 30 minutes.

Example 15

This is an example of preparing a Black toner at a weight ratio of organosol copolymer to pigment of 8 using the organosol prepared in Example 9, for which the weight ratio of D material to S material was 4.233 g of the organosol @ 13.76% (w/w) solids in Norpar™ 12 were combined with 63 g of Norpar™ 12, 4 g of Black Pigment Mogul L (Cabot Corporation, Billerica, Mass.) in an 8 ounce glass jar. This mixture was then milled in a 0.5 liter vertical bead mill (Model 6TSG-1/4, Amex Co., Ltd., Tokyo, Japan) charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber. The resultant liquid toner was centrifuged at 7500 RPM for 1 hour, and then the sediment was collected in a tray and dried at 50° C. for 24 hours. The dried toner was ground using a mortar and pestle for approximately 30 minutes.

Example 16

This is an example of preparing a Black toner at a weight ratio of organosol copolymer to pigment of 8 using the organosol prepared in Example 10, for which the weight ratio of D material to S material was 4.226 g of the organosol @ 14.17% (w/w) solids in Norpar™ 12 were combined with 70 g of Norpar™ 12, 4 g of Black Pigment Nipex 150T (Degussa Corporation, Akron, Ohio) and 0.4 g of Copy Charge NY VP-2351 (Clariant Corporation, Coventry, R1) in an 8 ounce glass jar. This mixture was then milled in a 0.5 liter vertical bead mill (Model 6TSG-1/4, Amex Co., Ltd., Tokyo, Japan) charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber. The resultant liquid toner was centrifuged at 7500 RPM for 1 hour, and then the sediment was collected in a tray and dried at 50° C. for 24 hours. The dried toner was ground using a mortar and pestle for approximately 30 minutes.

Example 17

This is an example of preparing a Black toner at a weight ratio of organosol copolymer to pigment of 8 using the organosol prepared in Example 7, for which the weight ratio of D material to S material was 4.267 g of the organosol @ 12.00% (w/w) solids in Norpar™ 12 were combined with 29 g of Norpar™ 12, 4 g of Black Pigment Nipex 150T (Degussa Corporation, Akron, Ohio) in an 8 ounce glass jar. This mixture was then milled in a 0.5 liter vertical bead mill (Model 6TSG-1/4, Amex Co., Ltd., Tokyo, Japan) charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber. The resultant liquid toner was centrifuged at 7500 RPM for 1 hour, and then the sediment was collected in a tray and dried at 50° C. for 24 hours. The dried toner was ground using a mortar and pestle for approximately 30 minutes.

Example 18

This is an example of preparing a Black toner at a weight ratio of organosol copolymer to pigment of 8 using the organosol prepared in Example 8, for which the weight ratio of D material to S material was 4.274 g of the organosol @ 11.69% (w/w) solids in Norpar™ 12 were combined with 22 g of Norpar™ 12, 4 g of Black Pigment EK8575P (Magruder Color Company, Tucson, Ariz.) in an 8 ounce glass jar. This mixture was then milled in a 0.5 liter vertical bead mill (Model 6TSG-1/4, Amex Co., Ltd., Tokyo, Japan) charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber. The resultant liquid toner was centrifuged at 7500 RPM for 1 hour, and then the sediment was collected in a tray and dried at 50° C. for 24 hours. The dried toner was ground using a mortar and pestle for approximately 30 minutes.

Example 19

This is an example of preparing a Yellow toner at a weight ratio of organosol copolymer to pigment of 8.5 using the organosol prepared in Example 4, for which the ratio of D material to S material was 8.190 g of the organosol @ 22.49% (w/w) solids in Heptane were combined with 104 g of Heptane, 5 g of Pigment Yellow 138 (Sun Chemical Company, Cincinnati, Ohio) and 0.48 g of Copy Charge PSY (Clariant Corporation, Coventry, R1) in an 8 ounce glass jar. This mixture was then milled in a 0.5 liter vertical bead mill (Model 6TSG-1/4, Amex Co., Ltd., Tokyo, Japan) charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber. The resultant liquid toner was centrifuged at 7500 RPM for 1 hour, and then the sediment was collected in a tray and dried at 50° C. for 24 hours. The dried toner was ground using a mortar and pestle for approximately 30 minutes.

Example 20

This is an example of preparing a Magenta toner at a weight ratio of organosol copolymer to pigment of 8.5 using the organosol prepared in Example 4, for which the ratio of D material to S material was 8.190 g of the organosol @ 22.49% (w/w) solids in Heptane were combined with 104 g of Heptane, 5 g of Pigment Red 81:4 (Magruder Color Company, Tucson, Ariz.) and 0.48 g of Copy Charge PSY (Clariant Corporation, Coventry, R.I.) in an 8 ounce glass jar. This mixture was then milled in a 0.5 liter vertical bead mill (Model 6TSG-1/4, Amex Co., Ltd., Tokyo, Japan) charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber. The resultant liquid toner was centrifuged at 7500 RPM for 1 hour, and then the sediment was collected in a tray and dried at 50° C. for 24 hours. The dried toner was ground using a mortar and pestle for approximately 30 minutes.

Example 21

This is an example of preparing a Cyan toner at a weight ratio of organosol copolymer to pigment of 8.5 using the organosol prepared in Example 4, for which the ratio of D material to S material was 8.190 g of the organosol @ 22.49% (w/w) solids in Heptane were combined with 104 g of Heptane, 5 g of Pigment Blue 15:4 (Sun Chemical Company, Cincinnati, Ohio) and 0.48 g of Copy Charge N4P VP 2481 (Clariant Corporation, Coventry, R.I.) in an 8 ounce glass jar. This mixture was then milled in a 0.5 liter vertical bead mill (Model 6TSG-1/4, Amex Co., Ltd., Tokyo, Japan) charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber. The resultant liquid toner was centrifuged at 7500 RPM for 1 hour, and then the sediment was collected in a tray and dried at 50° C. for 24 hours. The dried toner was ground using a mortar and pestle for approximately 30 minutes.

Example 22

This is an example of preparing a Black toner at a weight ratio of organosol copolymer to pigment of 8.5 using the organosol prepared in Example 4, for which the weight ratio of D material to S material was 8.190 g of the organosol @ 22.49% (w/w) solids in Heptane were combined with 105 g of Heptane, 5 g of Black Pigment Regal 300R (Cabot Corporation, Billerica, Mass.) in an 8 ounce glass jar. This mixture was then milled in a 0.5 liter vertical bead mill (Model 6TSG-1/4, Amex Co., Ltd., Tokyo, Japan) charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber. The resultant liquid toner was centrifuged at 7500 RPM for 1 hour, and then the sediment was collected into a tray and dried in a fluidized bed dryer.

The wet centrifuged "filter cake" was placed into the conical drying chamber of a fluid bed dryer (Niro Aeromatic, Niro Corp., Hudson, Wis.). Ambient air at about 35° C., was passed through the chamber (from bottom to top) with a flow rate sufficient to loft any dried powder and to keep the powder airborne inside the vessel (i.e., a fluidized powder bed). Bag filters in the vessel allow the air to leave the drying vessel while keeping the powder contained. Any toner that accumulated on the filter bags was blown down by a periodic reverse air flow through the filters. The sample was dried for approximately 10 to 20 minutes.

TABLE 4

Dry Toners Incorporating Copolymers Derived from Organosols

Black Toners (Various S Monomers)

| Ex. | Organosol | Pigment | Q/M (μC/g) | Toner particle Size $D_v$(μm) | Toner particle Size $D_n$(μm) |
|---|---|---|---|---|---|
| 11 | TCHMA/HEMA-TMI//EMA | EK8200 | 35.05 | 5.72 | 3.15 |
| 12 | TCHMA/HEMA-TMI//EMA | M120 | 27.14 | 5.00 | 3.37 |
| 13 | TCHMA/HEMA-TMI//EMA | Regal 300R | 23.05 | 18.88 | 10.83 |
| 14 | BHA/HEMA-TMI//EMA | EK8575P | 25.78 | 10.45 | 5.95 |
| 15 | ODA/HEMA-TMI//EMA | Mogul L | 23.05 | 4.77 | 2.28 |
| 16 | Exp61-TMI//EMA | Nipex 150T | 23.4 | 2.43 | 1.21 |

TABLE 4-continued

Dry Toners Incorporating Copolymers Derived from Organosols

Black Toners (Various D Monomers)

| Ex. | Organosol | Pigment | Q/M (μC/g) | Toner Particle Size $D_v$(μm) | Toner Particle Size $D_n$(μm) |
|---|---|---|---|---|---|
| 11 | TCHMA/HEMA-TMI//EMA | EK8200 | 35.05 | 5.72 | 3.15 |
| 17 | BHA/HEMA-TMI//St | Nipex 150T | 5.16 | 9.17 | 5.00 |
| 18 | ODA/HEMA-TMI//BMA | EK8575P | 27.61 | 6.12 | 4.50 |

Colored Toners Using Copolymer of Example 4

| Ex. | Color | Pigment | Q/M (μC/g) | Toner Particle Size $D_v$(μm) | Toner Particle Size $D_n$(μm) |
|---|---|---|---|---|---|
| 19 | Yellow | PY138 | 54.53 | 6.47 | 4.41 |
| 20 | Magenta | PR 81:4 | 35.20 | 11.95 | 6.45 |
| 21 | Cyan | PB 15:4 | 51.70 | 11.83 | 5.82 |

Black Toners Dried in Conventional Oven and Fluidized Bed Dryer

| Ex. | Organosol | Pigment | Q/M (μC/g) | Toner particle Size $D_v$(μm) | Toner particle Size $D_n$(μm) |
|---|---|---|---|---|---|
| 13 | TCHMA/HEMA-TMI//EMA | Regal 300R | 23.05 | 18.88 | 10.83 |
| 22 | TCHMA/HEMA-TMI//EMA | Regal 300R | 12.42 | 12.25 | 7.37 |

Example 23

Electrophotographic Printing of Dry Toner Incorporating Copolymer Derived From an Organosol This is an example of the use in an electrophotographic imaging process of the dry toner produced in Example 22 and incorporating a copolymer derived from the organosol of Example 4.

A used print cartridge for a conventional monochrome dry toner laser printer (Model ML-1250, Samsung Electronics Corp., Suwon, South Korea) was opened and any traces of remaining toner were vacuumed away to clean the cartridge. All cartridge components including the photoreceptor, development roller, and fur toner deposition roller were completely wiped to remove any residual toner traces. Approximately ten grams of the monochrome black dry toner of Example 22 was placed into the toner compartment of the print cartridge. The cartridge was then re-sealed and re-inserted into the laser printer. The printer was connected to a personal computer, and approximately ten test pages were printed on plain 20 pound test bond paper using both the "demonstration printing mode" of the printer and printing a resolution target sent as a bit map from the computer.

The resulting toned images on bond paper were fused offline by passing the printed pages through the heated and pressurized nip of a two roll fuser assembly at 220° C., 65 $lb_f/in^2$ and 14.5 inches/minute linear speed. The fused images exhibited exceptional durability. The reflectance optical density was measured as 0.55. The images showed high resolution with well-formed characters. The resolution at 64 dpi was better than the ML1250's original toner image, judging from the width of the white lines between the black toned lines. The ratio of the white line width to black line width was ~2 to 3 for the organosol derived dry toner compared to 1 to 3 for the standard ML1250 toned image. The edges of toned features appeared to be sharper and with much less toner scatter than for images produced using the standard ML1250 dry toner, which is prepared using conventional comminution and classification methods.

Other embodiments of this invention will be apparent to those skilled in the art upon consideration of this specification or from practice of the invention disclosed herein. Various omissions, modifications, and changes to the principles and embodiments described herein may be made by one skilled in the art without departing from the true scope and spirit of the invention which is indicated by the following claims.

What is claimed is:

1. A plurality of dry electrographic toner particles, comprising:

an amphipathic copolymer, wherein the dry electrographic toner particles are derived from an organosol comprising the amphipathic copolymer dispersed in a liquid carrier having a Kauri-Butanol number of less than 30 ml, and wherein the amphipathic copolymer comprises one or more S portions and one or more D portions, said one or more S portions and one or more D portions having respective solubilities in the liquid carrier that are sufficiently different from each other such that the S portions tend to be more solvated by the carrier than the D portions; and wherein the one or more S portions have a lower Tg than the one or more D portions.

2. The dry electrophotographic toner particles according to claim 1, further comprising a charge control additive.

3. The dry electrophotographic toner particles according to claim 2, wherein said charge control additive imparts a positive polarity to said toner particle.

4. The dry electrophotographic toner particles according to claim 1, further comprising at least one visual enhancement additive.

5. The dry electrophotographic toner particles according to claim 4, wherein said at least one visual enhancement additive is a pigment.

6. The dry electrophotographic toner particles according to claim 1, wherein said amphipathic copolymer has a glass transition temperature of between 0° C. and 100° C.

7. The dry electrophotographic toner particles according to claim 6, wherein said S portion has a glass transition temperature calculated using the Fox equation of at least 0° C.

8. The dry electrophotographic toner particles according to claim 6, wherein said D portion has a glass transition temperature calculated using the Fox equation of between 60° C. and 105° C.

9. The dry electrophotographic toner particles according to claim 1, wherein one or more of the S portions comprises a (meth)acrylic copolymer.

10. The dry electrophotographic toner particles according to claim 9, wherein the (meth)acrylic copolymer is derived from one or more polymerizable monomer(s) selected from the group consisting of alkylacrylates where the alkyl chain contains at least 10 carbon atoms and alkylmethacrylates where the alkyl chain contains at least 12 carbon atoms.

11. The dry electrophotographic toner particles according to claim 1, wherein one or more of the D portions comprises a (meth)acrylic copolymer.

12. The dry electrophotographic toner particles according to claim 11, wherein the (meth)acrylic copolymer is derived from one or more polymerizable monomer(s) selected from the group consisting of alkylacrylates where the alkyl chain contains fewer than 10 carbon atoms and alkylmethacrylates where the alkyl chain contains fewer than 12 carbon atoms.

13. The dry electrophotographic toner particles according to claim 9 or 11, wherein one or more S portions are chemically bonded to one or more of the D portions through a urethane linkage derived from dimethyl-m-isoprenyl benzyl isocyanate.

14. The dry electrophotographic toner particles according to claim 1 wherein the weight ratio of D portions to S portions is between 1/2 and 12/1.

15. The dry electrophotographic toner particles according to claim 1, wherein the S portion has a glass transition temperature calculated using the Fox equation (excluding grafting site components) of at least about 90° C.

16. The dry electrophotographic toner particles according to claim 1, wherein the S portion has a glass transition temperature calculated using the Fox equation (excluding grafting site components) of from about 100° C. to about 130° C.

17. The dry electrophotographic toner particles according to claim 1, wherein the S portion (excluding grafting site components) has a calculated Hildebrand solubility parameter of from about 16 $MPa^{1/2}$ to about 17.5 $MPa^{1/2}$.

18. The dry electrophotographic toner particles according to claim 1, wherein at least about 75% of the S portion (excluding grafting site components) is derived from ingredients selected from the group consisting of trimethyl cyclohexyl methacrylate; t-butyl methacrylate; n-butyl methacrylate; isobomyl (meth)acrylate; 1,6-Hexanediol di(meth) acrylate and combinations thereof.

19. The dry electrophotographic toner particles according to claim 1, wherein at least about 90% of the S portion (excluding grafting site components) is derived from ingredients selected from the group consisting of trimethyl cyclohexyl methacrylate; t-butyl methacrylate; n-butyl methacrylate; isobomyl (meth)acrylate; 1,6-Hexanediol di(meth) acrylate and combinations thereof.

20. A method of making dry electrophotographic toner particles, comprising the steps of:

a) providing an organosol comprising a plurality of binder particles dispersed in a liquid carrier, wherein the binder particles comprise at least one amphipathic copolymer comprising one or more S portions and one or more D portions, said one or more S portions and one or more D portions having respective solubilities in the liquid carrier that are sufficiently different from each other such that the S portions tend to be more solvated by the carrier than the D portions. and wherein the one or more S portions have a lower Tg than the one or more D portions; and b) incorporating the binder particles into dry electrophotographic toner particles, said incorporating comprising drying one or more ingredients comprising the binder particles, said binder particles being in a fluidized state during at least a portion of said drying step.

21. The method of claim 20, wherein the incorporating step comprises causing the organosol to mixingly contact one or more ingredients comprising at least one colorant.

22. The method of claim 21, wherein the amphipathic copolymer comprises one or more S material portions and one or more D material portions.

23. The method of claim 21, wherein the liquid carrier comprises a hydrocarbon.

24. The method of claim 23, wherein the liquid carrier comprises an aliphatic hydrocarbon.

25. The method of claim 24, wherein the aliphatic hydrocarbon comprises heptane.

26. The method of claim 21, wherein the liquid carrier comprises an oleophilic solvent.

27. The method of claim 22, wherein the weight ratio of D material to S material is in the range of 2/1 to 10/1.

28. The method of claim 21, wherein the ingredients incorporated into the dry toner particles further comprise a charge directing agent.

29. The method of claim 21, wherein the dried binder particles are positively charged.

30. The method of claim 21, wherein the dried binder particles are negatively charged.

31. The method of claim 21, wherein the colorant comprises a pigment colorant.

32. The method of claim 21, wherein the D material has an effective Tg of greater than about 50° C.

33. The method of claim 22, wherein each of the S and D materials is derived from ingredients comprising one or more free radically polymerizable monomers.

34. The method of claim 22, wherein the amphipathic copolymer has a graft structure comprising one or more D material portions grafted onto an S material portion.

35. The method of claim 22, wherein the S material is derived from ingredients comprising trimethyl cyclohexyl methacrylate.

36. The method of claim 22, wherein the S material is derived from ingredients comprising hydroxy ethylmethacrylate.

37. The method of claim 22, wherein the S material is derived from ingredients comprising octadecyl acrylate.

38. The method of claim 22, wherein the S material is derived from ingredients comprising dimethyl-m-isoprenyl benzylisocyanate.

39. The method of claim 22, wherein the S material has a glass transition temperature calculated using the Fox equation (excluding grafting site components) of at least about 90° C.

40. The method of claim 22, wherein the S material has a glass transition temperature calculated using the Fox equation (excluding grafting site components) of from about 100° C. to about 130° C.

41. The method of claim 22, wherein the S material (excluding grafting site components) has a calculated Hildebrand solubility parameter of from about 16 $MPa^{1/2}$ to about 17.5 $MPa^{1/2}$.

42. The method of claim 22, wherein at least about 75% of the S material (excluding grafting site components) is derived from ingredients selected from the group consisting of trimethyl cyclohexyl methacrylate; t-butyl methacrylate; n-butyl methacrylate; isobomyl (meth)acrylate; 1,6-Hexanediol di(meth)acrylate and combinations thereof.

43. The method of claim 22, wherein at least about 90% of the S material (excluding grafting site components) is derived from ingredients selected from the group consisting of trimethyl cyclohexyl methacrylate; t-butyl methacrylate; n-butyl methacrylate; isobornyl (meth)acrylate; 1,6-Hexanediol di(meth)acrylate and combinations thereof.

44. The method of claim 22, wherein the D material is derived from ingredients comprising trimethyl cyclohexyl methacrylate.

45. The method of claim 22, wherein the D material is derived from ingredients comprising ethyl methacrylate.

46. The method of claim 22, wherein the D material is derived from ingredients comprising styrene.

47. The method of claim 22, wherein the D material is derived from ingredients comprising butyl methacrylate.

48. The method of claim 22, wherein the absolute difference in Hildebrand solubility parameter between the S portion and the liquid carrier is from about 2 $MPa^{1/2}$ to about 3 $MPa^{1/2}$.

49. A method of making electrophotographic toner particles, comprising the steps of:

a) providing a first plurality of free radically polymerizable monomers, wherein at least one of the monomers comprises hydroxyl functionality;

b) free radically polymerizing the first plurality of monomers in a solvent to form a hydroxyl functional polymer, wherein the monomers and the hydroxyl functional polymer are soluble in the solvent;

c) reacting a compound having NCO functionality and free radically polymerizable functionality with the hydroxyl functional polymer under conditions such that at least a portion of the NCO functionality of the compound reacts with at least a portion of the hydroxyl functionality of the polymer to form one or more urethane linkages by which the compound is linked to the polymer, thereby providing a polymer with pendant free radically polymerizable functionality;

d) copolymerizing ingredients comprising (i) the polymer with pendant free radically polymerizable functionality, (ii) a second plurality of one or more free radically polymerizable, monomers, and (iii) a liquid carrier in which polymeric material derived from ingredients comprising the one or more additional monomers is insoluble, said copolymerizing occurring under conditions effective to form an organosol comprising an amphipathic copolymer dispersed in the liquid carrier and said first and second pluralities of monomers being selected such that the amphipathic copolymer comprises one or more S portions and one or more D portions. said one or more S portions and one or more D portions having respective solubilities in a liquid carrier having a Kauri-butanol number of less than 30 ml that are sufficiently different from each other such that the S portions tend to be more solvated by the carrier than the D portions and wherein the one or more S portions have a lower Tg than the one or more D portions; and e) incorporating the amphipathic copolymer into dry electrophotographic toner particles.

50. A dry electrophotographic toner particle comprising at least one visual enhancement particle and a polymeric binder derived from ingredients comprising an amphipathic copolymer prepared according to the method of claim 49.

51. A method of electrophotographically forming an image on a substrate surface, comprising the steps of:

a) providing a plurality of dry toner particles, said toner particles comprising an amphipathic copolymer and optionally at least one visual enhancement particle wherein the dry electrographic toner particles are derived from an organosol comprising the amphipathic copolymer and the visual enhancement particle dispersed in a liquid carrier having a Kauri-Butanol number of less than 30 ml, and wherein the amphipathic copolymer comprises one or more S portions and one or more D portions, said one or more S portions and one or more D portions having respective solubilities in the liquid carrier that are sufficiently different from each other such that the S portions tend to be more solvated by the carrier than the D portions, and wherein the one or more S portions have a lower Tg than the one or more D portions; and b) causing an image comprising the toner particles to be formed on the substrate surface.

52. A method of electrophotographically forming an image on a substrate surface, comprising the steps of:

a) providing a plurality of dry toner particles, said toner particles comprising at least one visual enhancement particle and a-an amphipathic copolymer, wherein the dry electrographic toner particles are derived from an organosol comprising the amphipathic copolymer and the visual enhancement particle dispersed in a liquid carrier having a Kauri-Butanol number of less than 30 ml. and wherein the amphipathic copolymer comprises one or more S portions and one or more D portions, said one or more S portions and one or more D portions having respective solubilities in the liquid carrier that are sufficiently different from each other such that the S portions tend to be more solvated by the carrier than the D portions, and wherein the one or more S portions have a lower Tg than the one or more D portions; and b) causing an image comprising the toner particles to be formed on a charged surface; and c) transferring the image from the charged surface to the substrate surface.

* * * * *

UNITED STATES PATENT AND TRADEMARK OFFICE

CERTIFICATE OF CORRECTION

PATENT NO. : 7,135,264 B2
APPLICATION NO. : 10/612243
DATED : November 14, 2006
INVENTOR(S) : Qian et al.

It is certified that error appears in the above-identified patent and that said Letters Patent is hereby corrected as shown below:

Column 35
Line 31, “isobomyl” should be --isobornyl--.
Line 38, “isobomyl” should be --isobornyl--.

Column 36
Line 51, “isobomyl” should be --isobornyl--.

Column 38
Line 29, “a-an” should be --an--.
Line 34, “ml.” should be --ml,--.

Signed and Sealed this

First Day of May, 2007

JON W. DUDAS
*Director of the United States Patent and Trademark Office*